US007599653B2

(12) United States Patent
Asakura et al.

(10) Patent No.: US 7,599,653 B2
(45) Date of Patent: Oct. 6, 2009

(54) IMAGE FORMING APPARATUS

(75) Inventors: Kenji Asakura, Kyoto (JP); Shinji Yamana, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 174 days.

(21) Appl. No.: 11/712,993

(22) Filed: Mar. 2, 2007

(65) Prior Publication Data

US 2007/0212136 A1 Sep. 13, 2007

(30) Foreign Application Priority Data

Mar. 2, 2006 (JP) ..... P2006-056841

(51) Int. Cl.
*G03G 15/20* (2006.01)

(52) U.S. Cl. ..... 399/340; 399/320; 430/124.21; 430/124.22

(58) Field of Classification Search ..... 399/340, 399/320, 219, 216; 430/124.21, 124.22
See application file for complete search history.

(56) References Cited

U.S. PATENT DOCUMENTS 5,732,317 A * 3/1998 Orchard et al. ..... 399/325
5,737,666 A 4/1998 Lior et al.
6,915,101 B2 * 7/2005 Goldman et al. ..... 399/340
2005/0254867 A1 * 11/2005 Kurotori et al. ..... 399/340

FOREIGN PATENT DOCUMENTS

JP 9-505411 5/1997
JP 2004-333866 A 11/2004
JP 2005-070572 3/2005

* cited by examiner

*Primary Examiner*—David M Gray
*Assistant Examiner*—Ryan D Walsh
(74) *Attorney, Agent, or Firm*—Nixon & Vanderhye P.C.

(57) ABSTRACT

An image forming apparatus capable of applying an adequate amount of fixing fluid to an unfixed toner image and producing high-quality images having high resolution and high image density with stability for a longer period of time while protecting the interior thereof against fixing fluid leakage and achieving reduction in fixing fluid consumption is provided. In an image forming apparatus, a fixing fluid is applied to a toner image on an intermediary transfer belt by a coating roller, and the toner image in a swollen/softened state is fixed onto a recording medium. By a second seal member composed of a film-shaped member and a supporting member, a gap between the coating roller and a fixing fluid chamber which has the opening and places the coating roller therein is closed to avoid leakage of the fixing fluid.

8 Claims, 12 Drawing Sheets

IMAGE FORMING APPARATUS

CROSS-REFERENCE TO RELATED APPLICATION

This application claims priority to Japanese Patent Application No. JP 2006-056841, which was filed on Mar. 2, 2006, the contents of which, are incorporated herein by reference, in their entirety.

BACKGROUND OF THE INVENTION

1. Field of the Invention

The present invention relates to an image forming apparatus.

2. Description of the Related Art

Image forming apparatuses designed to form images with toner by means of electrophotography, electrostatic recording, or otherwise find application in copying machines, printers, facsimile machines, and so forth for general purpose use. As an electrophotographic image forming apparatus, for example, there has heretofore been known the one composed of: a photoreceptor having formed on its surface a photosensitive layer; a charging section for electrifying the surface of the photoreceptor; an exposure section for applying signal light to the surface of the photoreceptor in a charged state whereby to form an electrostatic latent image corresponding to predetermined image data; a developing section for supplying toner to the electrostatic latent image on the surface of the photoreceptor whereby to change (develop) the electrostatic latent image into a toner image; a transfer section for transferring the toner image on the surface of the photoreceptor onto a recording medium; a fixing section for fixing the toner image transferred on the recording medium into place; and a cleaning section for removing residual toner remaining on the surface of the photoreceptor following the completion of the transference of the toner image on the recording medium. In such an electrophotographic image forming apparatus, its fixing section is designed to achieve fixation of a toner image by melting the toner constituting the toner image, and therefore a heat fixing method is generally adopted for heating the toner image at a high temperature. However, the heat fixing method necessitates heating section such as a heater that is high in power consumption to effect heating, which results in an undesirable increase in the quantity of power consumed. Thus, in the light of environmental issues such as global warming, extensive research and study have been made in an effort to achieve a reduction in power consumption. As an example of fixing methods that consume less power, there has been known a wet fixing method that is in no need of a heating section such as a heater. According to the wet fixing method, a fixing fluid which produces the effect of swelling and softening toner is applied to a toner image to swell and soften the toner constituting the toner image. In this way, the toner image can be fixed onto a recording medium. More specifically, for example, in an image forming apparatus designed to perform image formation by using a method involving a step of transferring a toner image formed on a surface of a photoreceptor onto an intermediary transfer medium such as an intermediary transfer belt and a step of transferring and fixing the toner image formed on the intermediary transfer medium onto a recording medium, before the toner image formed on the intermediary transfer medium is fixed onto the recording medium, a fixing fluid is applied to the toner image to swell and soften the toner constituting the toner image.

There has also been known a fixing fluid coating apparatus composed of a fixing fluid chamber for storing a fixing fluid in which is housed a coating roller which is used to apply the fixing fluid to an unfixed toner image formed on an intermediary transfer medium in a contact manner (for example, refer to Japanese Unexamined Patent Publication JP-A 2004-333866). Moreover, shown in FIG. 8B related to JP-A 2004-333866 is a sponge roller as an example of the coating roller for applying the fixing fluid to the unfixed toner image in a contact manner. The sponge roller has an axially disposed path for the fixing fluid. In the sponge roller, the fixing fluid externally supplied to the fixing fluid path is allowed to permeate through its surface, so that the fixing fluid can be applied to the unfixed toner image in a contact manner. That is, the coating roller disclosed in JP-A 2004-333866 is made of a material which exhibits liquid permeability and has a space for storing the fixing fluid formed interiorly thereof. In this coating roller, the fixing fluid stored inside exudes to the top surface, so that the exudation of the fixing fluid can be applied to the unfixed toner image in a contact manner. Moreover, as described in paragraphs [0050] to [0051] of JP-A2004-333866 with reference to FIG. 9, there is proposed a fixing fluid coating apparatus that includes, in addition to the fixing fluid chamber and the coating roller, an excessive fixing fluid recovery portion for collecting an excess of the fixing fluid remaining on a recording medium. The excessive fixing fluid recovery portion is designed in the form of a cartridge so as to be freely replaceable. That is, according to JP-A 2004-333866, part of the components constituting the fixing fluid coating apparatus is designed in the form of a cartridge so as to be freely attachable to and detachable from a main body of an image forming apparatus.

The sponge roller disclosed in JP-A 2004-333866 is composed of a single liquid-permeable material. In this case, however, it is extremely difficult to exercise control over the amount of application of the fixing fluid properly. Therefore, a larger amount of the fixing fluid than is necessary may be applied to a recording medium, which is causative of generation of, for example, wrinkles and curls in the recording medium, especially in the case of using a paper sheet or the like as the recording medium. Another problem is an undesirable increase in fixing fluid consumption. Furthermore, in the fixing fluid coating section disclosed in JP-A 2004-333866, the sponge roller is disposed vertically below the fixing fluid chamber. In this construction, it is inevitable that, as the sponge roller is rotated, so its surface is squeezed at the location where the sponge roller and the fixing fluid chamber make contact with each other, thus causing the fixing fluid to leak outside. As a result, the constituent components disposed inside the image forming apparatus are contaminated with a leakage fixing fluid, which leads to shortening of the service life of the image forming apparatus. Thus, this construction not only necessitates an additional upkeep operation to remove a leakage fixing fluid but also gives rise to a possibility of further augmentation of the amount of the fixing fluid to be consumed. In addition, because of its less-than-satisfactory long-term durability, the sponge roller is in need of replacement over the course of time. However, JP-A 2004-333866 pays no regard to the section for replacing the sponge roller at all. This could lead to impairment of the long-term durability of the image forming apparatus.

Moreover, in the sponge roller disclosed in JP-A 2004-333866, the fixing fluid is supplied to the fixing fluid path through a feeder formed in the rotary shaft of the roller so as to communicate with the fixing fluid path. However, JP-A 2004-333866 provides no specific description about how the fixing fluid is externally supplied to the rotary shaft. That is, it is difficult in reality to implement the sponge roller thus constructed. Let it be assumed that the front end of the rotary shaft of the sponge roller has a section connected thereto, for supplying the fixing fluid from external. In this case, since the rotary shaft is designed to rotate every time image formation is effected, it follows that the connection suffers from a durability disadvantage, wherefore the fixing fluid may leak from the connection to a bearing portion that will eventually cause contamination of the interior of the image forming apparatus. Furthermore, in the fixing fluid coating apparatus disclosed in JP-A 2004-333866, only the excessive fixing recovery portion is designed in the form of a cartridge. In this case, two upkeep operations, namely replenishment of the fixing fluid and discard of an excess of the fixing fluid need to be carried out on an individual basis, which results in deterioration in ease of handling of the image forming apparatus as a whole.

SUMMARY OF THE INVENTION

An object of the invention is to provide an image forming apparatus capable of applying an adequate amount of fixing fluid to an unfixed toner image and producing high-quality images having high resolution and high image density with stability for a longer period of time while protecting the interior thereof against fixing fluid leakage and achieving reduction in fixing fluid consumption.

The invention provides an image forming apparatus to form images by means of electrophotography or electrostatic recording, comprising:

a toner image bearing section for bearing an unfixed toner image thereon; and a fixing fluid applying section for applying a fixing fluid which provides an effect of fixing toner onto a recording medium, to the unfixed toner image on the toner image bearing section, wherein the fixing fluid applying section includes:

a fixing fluid chamber having an opening formed facing the toner image bearing section;

an applying member formed into a roller shape and placed in an interior space of the fixing fluid chamber, for applying the fixing fluid to the unfixed toner image on the toner image bearing section in contact with the toner image bearing section, which is supported inside the fixing fluid chamber so as to be rotatable and moved to contact with and release from the toner image bearing section, and in which at least a certain part is projected outward through the opening of the fixing fluid chamber facing the toner image bearing section in spaced to a side wall of the fixing fluid chamber;

a seal member for closing a gap between the opening of the fixing fluid chamber and the applying member; and a contact and release operation section for supporting the fixing fluid chamber so that the applying member moves to contact with and release from the toner image bearing section, wherein at least the fixing fluid chamber, the applying member, and the seal member are integral with one another as a single unit which is freely attachable to and detachable from a main body of the image forming apparatus.

According to the invention, the image forming apparatus, which effects image formation by means of electrophotography or electrostatic recording, is composed of the toner image bearing section and the fixing fluid applying section. The fixing fluid applying section includes: the fixing fluid chamber having an opening for housing the applying member; the applying member for applying the fixing fluid to the unfixed toner image on the toner image bearing section in contact with the toner image bearing section, in which at least a certain part is projected outward through the opening of the fixing fluid chamber; the seal member; and the contact and release operation section for supporting the fixing fluid chamber so that the applying member moves to contact and release from the toner image bearing section. The fixing fluid applying section is made attachable to and detachable from the main body of the image forming apparatus. The gap between the opening of the fixing fluid chamber and the applying member is closed with the seal member. In this construction, for example, at the time of attachment and detachment of the fixing fluid applying section, during the conveyance of the image forming apparatus, and in natural disaster situations such as an earthquake, no leakage of the fixing fluid will occur. That as, the interior of the image forming apparatus is free from contamination of a leakage fixing fluid. Moreover, of the components constituting the fixing fluid applying section, at least the fixing fluid chamber, the applying member, and the seal member are unitized in the form of a cartridge. In this case, since the replenishment of the fixing fluid and the replacement of the constituent components such as the applying member and the seal member can be achieved at one time, occurrence of problems such as fixing fluid leakage resulting from quality degradation of the applying member and the seal member and excessive supply of the fixing fluid to the toner image can be prevented. This makes it possible to achieve application of the fixing fluid with stability, and thereby produce high-quality images having high resolution and high image density with stability for a longer period of time. Further, since the applying member and the seal member are each replaced with the new one after a certain period of time, it is possible to use inexpensive materials therefor, and thereby achieve a reduction in cost for producing the fixing fluid applying section.

In the invention, it is preferable that: the fixing fluid chamber places the applying member and also stores the fixing fluid in its interior space; that the applying member is provided as a first applying member which is supported inside the fixing fluid chamber so as to be rotatable and moved to contact with and release from the toner image bearing section, has at least its certain part projected outward through the opening of the fixing fluid chamber facing the toner image bearing section in spaced to a side wall of the fixing fluid chamber, has at least its certain part located vertically above a level of the fixing fluid within the fixing fluid chamber, and has a slant region formed at its axial end portion, a diameter of its cross-section in a direction perpendicular to the length of the first applying member of which is tapered from a position near the end portion to the end portion; and that the seal member is provided as a first seal member which is disposed so as to move to contact and release from the applying member, has an axial end portion which is brought into contact with the slant region of the applying member to close the gap between the opening of the fixing fluid chamber and the applying member.

According to the invention, the fixing fluid chamber places the applying member and also stores the fixing fluid. In the first applying member for use as the applying member, at least a certain part is dipped in the fixing fluid, and a slant region is formed at the axial end portion, with the diameter of its cross-section in the direction perpendicular to the length of the first applying member tapered from a position near the end portion to the end portion. In the first seal member for use as the seal member, the axial end portion is brought into contact with the slant region of the applying member to close the gap between the opening of the fixing fluid chamber and the first applying member. In this construction, the gap between the fixing fluid chamber and the first applying member can be closed entirely circumferentially of the opening of the fixing fluid chamber simply by moving the first seal member in a direction radially of a section perpendicular to the length of the first applying member. Moreover, it never occurs that, upon contact with or separation from the first applying member, the first seal member rubs against the surface of the first applying member. This helps prevent occurrence of problems such as an undesirable increase of rotary torque in the first applying member resulting from surface damage and abrasion of the first seal member.

In the invention, it is preferable that the fixing fluid applying section further comprises a cleaning member which is rotatably supported inside the fixing fluid chamber, makes contact with the first applying member, and is so arranged as to be kept clear of the fixing fluid within the fixing fluid chamber, and in which, at least a surface layer is made of a material which is larger in contact angle with water than the surface of the first applying member.

According to the invention, in the fixing fluid chamber, the cleaning member is disposed in contact with the first applying member but out of contact with the fixing fluid. In the cleaning member, at least the surface layer is made of a material which is larger in contact angle with water than the surface of the first applying member. In this construction, a toner in a swollen state deposited on the surface of the first applying member is adhered to the cleaning member, wherefore the first applying member is free from redeposition of the toner. Thus, by removing the toner from the surface of the first applying member in that way, it is possible to ensure that the ability of the first applying member to apply the fixing fluid to the unfixed toner image is maintained at a high level for a longer period of time, and thereby produce high-quality images with stability. Moreover, the cleaning member is so arranged as to be kept clear of the fixing fluid. Since the swollen toner adherent to the surface of the cleaning member is gradually dried and is eventually stuck thereto, neither peeling down nor peeling off of the toner takes place. Accordingly, the swollen toner portions deposited on the surface of the first applying member can be stuck on top of one another on the surface of the cleaning member thereby removing the toner deposited on the surface of the first applying member more reliably. Moreover, the fixing fluid is free from contamination of scattered toner portions. Further, by unitizing the first applying member, the fixing fluid chamber, and the cleaning member in the form of a single unit of the fixing fluid applying section, it is possible to maintain the positional relationship between the first applying member and the cleaning member constant, wherefore there arises no positional deviation at the time of attachment to and detachment from the main body of the image forming apparatus. Accordingly, the first applying member is subjected to cleaning (removal of toner from its surface) without fail. Another advantage of the unitization lies in the fact that the replenishment of the fixing fluid and the replacement of the first applying member and the cleaning member can be achieved at one time. It will thus be seen that the first applying member is able to apply the fixing fluid to the toner image with stability for a longer period of time without suffering from a failure of cleaning resulting from excessive deposition of the toner on the cleaning member.

In the invention, it is preferable that the fixing fluid applying section further comprises:

a deformable fixing fluid container having an opening placed inside the fixing fluid chamber, which is filled with the firing fluid; and an application wick for supplying the fixing fluid within the fixing fluid container to the first applying member, in which one end is inserted through the opening into the fixing fluid container to dip with the fixing fluid, and the other end is arranged in pressure-contact with the first applying member.

According to the invention, in the fixing fluid chamber is placed the deformable fixing fluid container having an opening which is filled with the fixing fluid. In this construction, the interior of the image forming apparatus can be protected from contamination of a leakage fixing fluid more reliably. In terms of leakage prevention, a non-deformable airtight container is advantageous over the deformable container. However, in the case of using a non-deformable airtight container, as the fixing fluid stored therein is consumed gradually, a negative pressure is developed in the airtight container due to the difference between the pressure in the airtight container and atmospheric pressure, which results in a failure of supplying the fixing fluid to the coating roller properly. On the other hand, in the case of using a deformable fixing fluid container such as suggested in the invention, as the fixing fluid stored therein is consumed gradually, so the fixing fluid container becomes deformed due to a decrease in inner volume, in consequence whereof there results no development of a negative pressure. This allows stable application of the fixing fluid to the applying member. Moreover, the application wick is used as the section for supplying the fixing fluid charged in the fixing fluid container to the first applying member. The application wick has its one end inserted through the opening into the fixing fluid container to dip with the fixing fluid, and the other end arranged in pressure-contact with the first applying member. By virtue of such a simple configuration, the supply section is less prone to breakage, wherefore the fixing fluid can be applied to the applying member with stability.

In the invention, it is preferable that the fixing fluid applying section further includes:

a liquid level detecting section for detecting an amount of the fixing fluid within the fixing fluid chamber; and a replacement timing indicating section for notifying of a timing of replacement of the fixing fluid applying section from a result detected by the liquid level detecting section.

According to the invention, the fixing fluid applying section is further provided with the liquid level detecting section for detecting the amount of the fixing fluid within the fixing fluid chamber and the replacement timing indicating section for notifying of the timing of replacement of the fixing fluid applying section. In this construction, it is possible to determine the timing of replacement of the fixing fluid applying section without fail, and thus prevent improper fixation of the toner image onto a recording medium resulting from, for example, fixing fluid shortages. To be mentioned specially is that the fixing fluid contains a volatile component and thus there may be cases where the total fixing fluid consumption is in reality greater than the amount of the fixing fluid consumed for toner image fixation. That is, with the provision of the liquid level detecting section, in contrast to the case of estimating fixing fluid consumption on the basis only of the number of images produced, actual fixing fluid consumption can be determined without fail.

In the invention, it is preferable that the liquid level detecting section includes:

a hollow position control member having a plurality of through holes formed on its side wall that permit inflow and outflow of the fixing fluid, in which one end protrudes from a liquid level of the fixing fluid within the fixing fluid chamber into the interior space of the fixing fluid chamber, and the other end is supported on the fixing fluid chamber while being dipped in the fixing fluid;

a first fixing-fluid level indicator member put in an interior space of the hollow position control member so as to float in the fixing fluid while moving up-and-down to change its vertical position depending upon increase and decrease of the fixing fluid;

a first position detecting section for detecting a position of the first fixing-fluid level indicator member in its vertical direction; and a fixing-fluid amount calculation section for determining the amount of the fixing fluid by calculation from a result detected by the first position detecting section.

According to the invention, there is provided the first fixing-fluid level indicator member which is able to float in the fixing fluid while moving up-and-down to change its vertical position depending upon increase and decrease of the fixing fluid. This allows easy ascertainment of actual fixing fluid consumption. The first fixing-fluid level indicator member is placed in the interior space of the hollow member which is supported by the fixing fluid chamber in the vertical direction. The hollow member has a plurality of through holes formed on its side wall that permit inflow and outflow of the fixing fluid, and at least a certain part of which is dipped in the fixing fluid. The hollow member regulates horizontal movement of the first fixing-fluid level indicator member to ensure that it moves only in the vertical direction. The vertical position of the first fixing-fluid level indicator member is detected by the first position detecting section. From the detection result, the fixing-fluid amount calculation section (for example, a calculation section of a control unit) determines the amount of the fixing fluid by calculation. In this way, the amount of the fixing fluid within the fixing fluid chamber can be determined with accuracy. That is, by virtue of the liquid level detecting section composed of the first fixing-fluid level indicator member, the hollow member, the first position detecting section, and the fixing-fluid amount calculation section, fixing fluid consumption (=the remaining amount of the fixing fluid within the fixing fluid chamber) can be readily determined with accuracy.

Moreover, of the components constituting the liquid level detecting section, the first fixing-fluid level indicator member and the hollow member are included in the cartridge-type unit of the fixing fluid chamber, the first applying member, etc. for constituting the fixing fluid applying section, whereas the first position detecting section and the fixing-fluid amount calculation section are fixedly attached to certain locations in the interior of the image forming apparatus. In this construction, for example, at the time of attachment and detachment of the fixing fluid applying section to and from the main body of the image forming apparatus, there arises no positional deviation among the first fixing-fluid level indicator member, the hollow member, the first position detecting section, and the fixing-fluid amount calculation section, wherefore the amount of the fixing fluid within the fixing fluid chamber can be ascertained with accuracy at all times. Moreover, for example, when the image forming apparatus needs replenishing, the fixing fluid applying section provided integrally with the fixing fluid chamber which is filled with the fixing fluid is detached in its entirety. In this case, in contrast to the case of supplying the fixing fluid alone, the image forming apparatus can be prevented from being interiorly contaminated with a leakage fixing fluid without fail.

In the invention, it is preferable that: the applying member is provided as a second applying member formed into a roller shape which is supported inside the fixing fluid chamber so as to be rotatable and moved to contact with and release from the toner image bearing section, with at least a certain part of which projected outward through the opening of the fixing fluid chamber facing the toner image bearing section in spaced to a side wall of the fixing fluid chamber, and in which is placed a fixing fluid storage chamber for storing therein the fixing fluid whereby to apply the fixing fluid within the fixing fluid storage chamber to the unfixed toner image on the toner image bearing section in contact with the toner image bearing section; and that the seal member is provided as a second seal member for closing the gap between the opening of the fixing fluid chamber and the applying member, which is composed of a film-shaped member formed at a distance from or in intimate contact with the surface of a part of the applying member which is placed in the fixing fluid chamber and a supporting member for supporting the film-shaped member that is disposed in contact with both sides of the opening in longitudinal direction of the fixing fluid chamber and with a part of the surface of the applying member in the vicinity of the both sides of the opening.

According to the invention, the second applying member for use as the applying member has the fixing fluid storage chamber disposed interiorly thereof. The fixing fluid within the fixing fluid storage chamber exudes to the surface of the second applying member whereby to apply the fixing fluid to the toner image. At the opening of the fixing fluid chamber, the part of the second applying member other than the part exposedly projected outward is hermetically sealed with the second seal member. The second seal member for use as the seal member closes the gap between the opening of the fixing fluid chamber and the second applying member. With this construction, it is possible to avoid outward leakage and volatilization of the fixing fluid, as well as to make the fixing fluid applying section compact that leads to miniaturization of the main body of the image forming apparatus. Moreover, by unitizing the components such as the fixing fluid chamber, the second applying member, and the second seal member in the form of a single, cartridge-type fixing fluid applying section, it is possible to maintain the positional relationship among the constituent components constant. Accordingly, there arises no positional deviation at the time of, for example, attachment and detachment of the fixing fluid applying section to and from the main body of the image forming apparatus, wherefore the fixing fluid can be applied to the toner image with stability. Further, since the fixing fluid applying section is designed in the form of a cartridge, no leakage of the fixing fluid will occur during its attachment and detachment, and also the replenishment of the fixing fluid and the replacement of the constituent components can be achieved at one time.

In the invention, it is preferable that the second applying member includes:

a second fixing-fluid level indicator member which is supported inside the fixing fluid storage chamber so as to be rotatable about the axis of the second applying member depending upon increase and decrease of the fixing fluid;

a second position detecting section for detecting a position of the second fixing-fluid level indicator member; and fixing-fluid amount calculation section for determining the amount of the fixing fluid by calculation from a result detected by the second position detecting section.

According to the invention, the second fixing-fluid level indicator member is disposed inside the fixing fluid storage chamber of the second applying member. The second position detecting section, which is disposed externally of the second applying member, detects the position of the second fixing-fluid level indicator member in the fixing fluid storage chamber. From the detection result, the fixing-fluid amount calculation section determines the amount of the fixing fluid by calculation. In this way, the remaining amount of the fixing fluid within the second applying member can be determined with accuracy, with consideration given to the amount of the fixing fluid that has been volatilized into the air. Moreover, the second applying member is included in the cartridge-type fixing fluid applying section. The second fixing-fluid level indicator member is supported by the second applying member so as to be rotatable about the axis of the second applying member. The second position detecting section is supported at a predetermined location externally of the fixing fluid chamber by the main body of the image forming apparatus. Accordingly, the remaining amount of the fixing fluid can be determined with accuracy at all times without sustaining any positional deviation among those constituent components. Further, the second fixing-fluid level indicator member floats in the fixing fluid while being pivoted about the axis of the second applying member. Being simple in structure and being achieved inexpensively, even if the second fixing-fluid level indicator member is included in the cartridge-type unit of other components and is thus made replaceable therewith, there arises no increase in manufacturing cost. In addition, since the fixing fluid applying means is designed in the form of a cartridge, no leakage of the fixing fluid will occur during its attachment and detachment, and also the replenishment of the fixing fluid and the replacement of the constituent components can be achieved at one time.

In the invention, it is preferable that the fixing fluid chambers is designed as a vessel member including a flat-shaped portion which is a bottom face when mounted in the image forming apparatus, and a lateral side constituted by a surface having a curvature.

According to the invention, in the vessel-shaped fixing fluid chamber, the bottom face is flat-shaped and the face other than the bottom face is made to have a curvature. With this construction, even if the cartridge of the fixing fluid applying section is in storage for some time separately from the main body of the image forming apparatus, no leakage of the fixing fluid will occur. Accordingly, it is possible to produce in advance the storable cartridge of the fixing fluid applying section in large quantity, and thus achieve cost reduction, for example.

BRIEF DESCRIPTION OF THE DRAWINGS

Other and further objects, features, and advantages of the invention will be more explicit from the following detailed description taken with reference to the drawings wherein:

FIGS. 5A through 5C are views schematically illustrating the structure of the liquid level detecting section, in which FIG. 5A is a fragmentary longitudinal cross-sectional sectional view showing the coating roller, and FIGS. 5B and 5C are cross-sectional views showing the coating roller;

FIGS. 8A through 8C are views showing the behavior of a first seal member, in which FIGS. 8A and 8B are sectional views showing how a gap between a fixing fluid chamber and a coating roller is closed with the first seal member, and FIG. 8C is a sectional view of the coating roller illustrating the gap-closing operation using the first seal member depicted in FIGS. 8A and 8B;

FIGS. 12A and 12B are views schematically illustrating the structure of the contact and release operation section, in which FIG. 12A is a top view thereof and FIG. 12B is a sectional view thereof taken along the line XIIb-XIIb of FIG. 12A.

DETAILED DESCRIPTION

Figure 1:
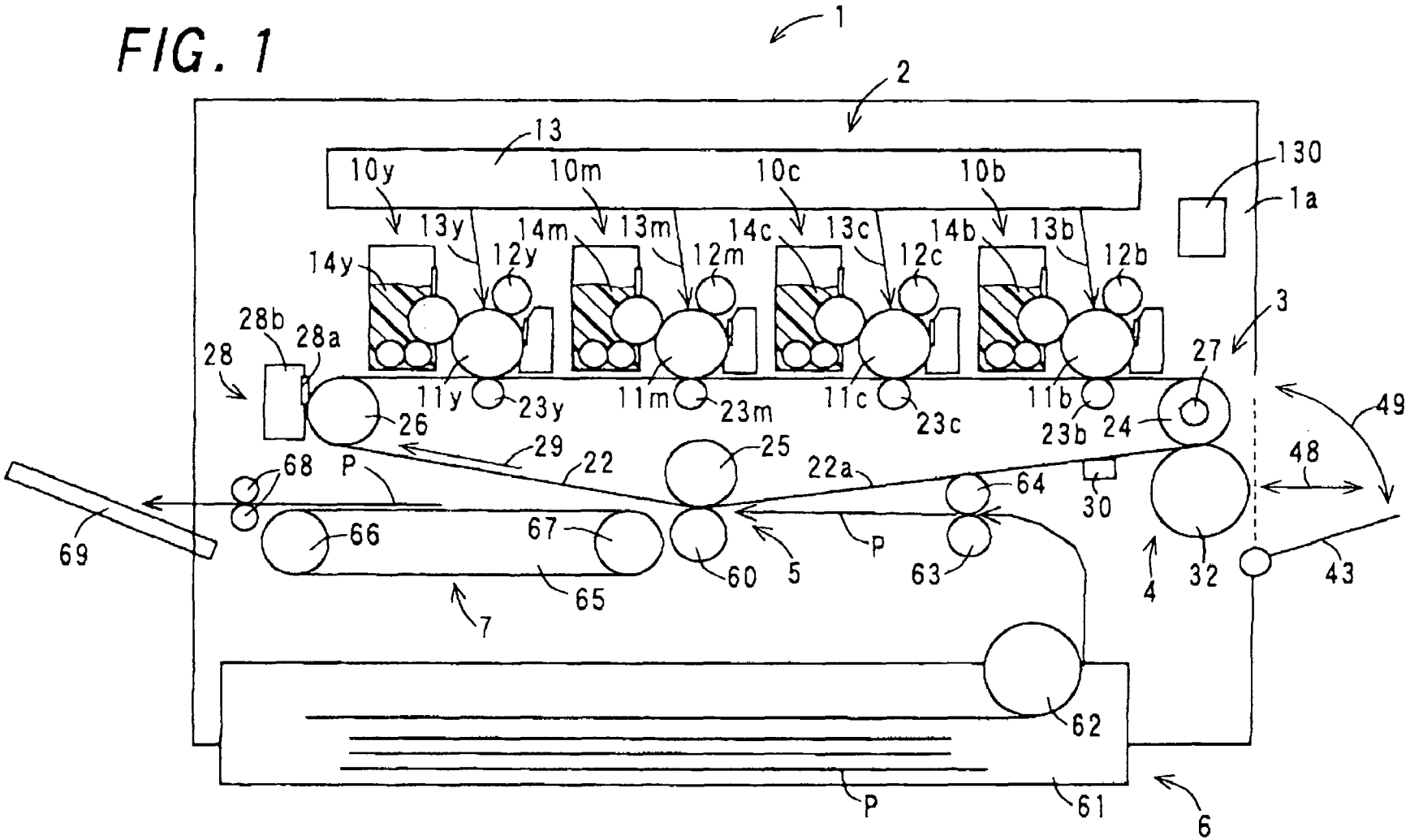
FIG. 1 is a sectional view schematically illustrating the constitution of an image forming apparatus according to a first embodiment of the invention.

Now referring to the drawings, preferred embodiments of the invention are described below.

Figure 2:
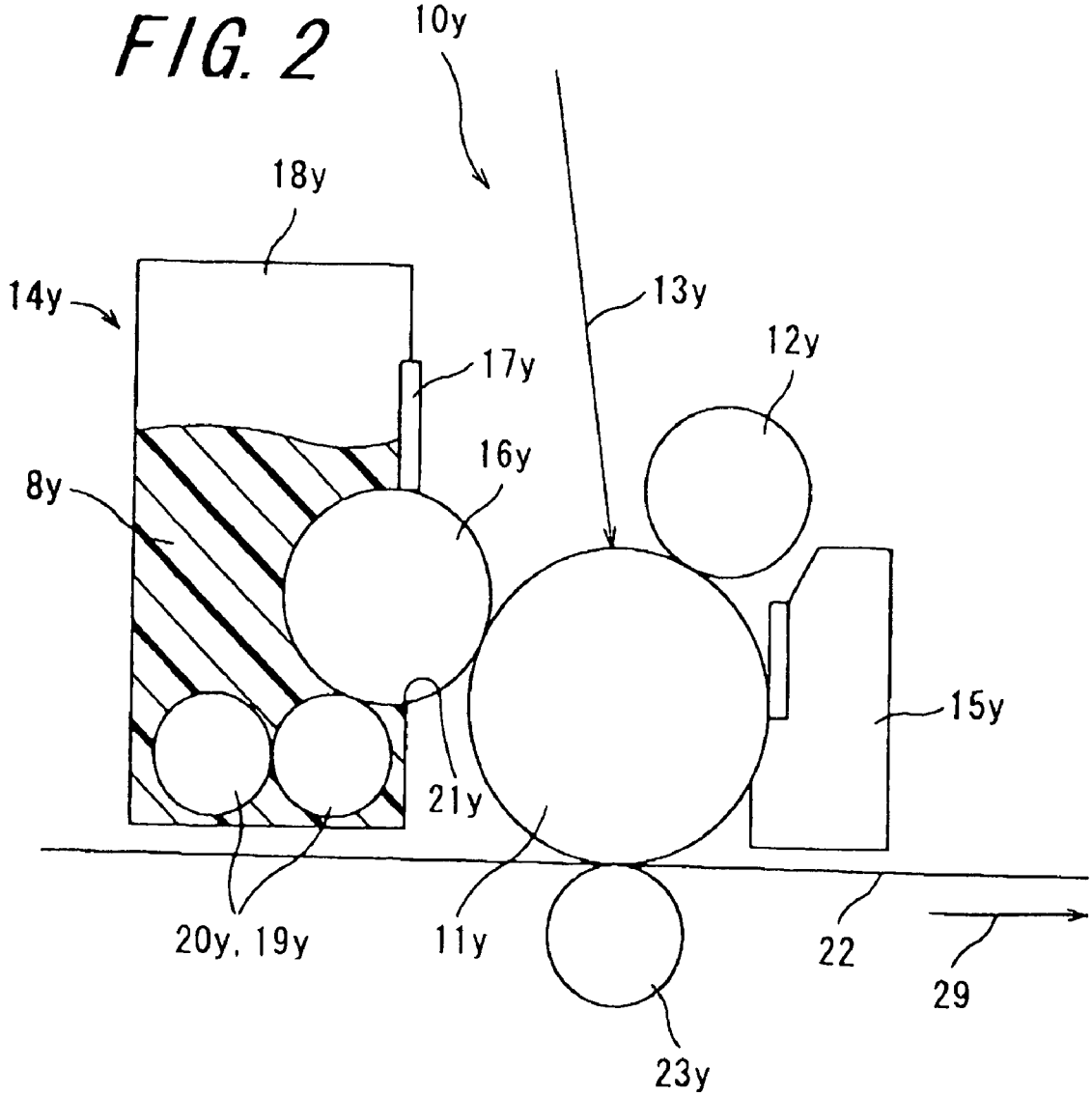
FIG. 2 is an enlarged sectional view showing the structure of the main portion of the image forming apparatus 1 depicted in FIG. 1.
Figure 3:
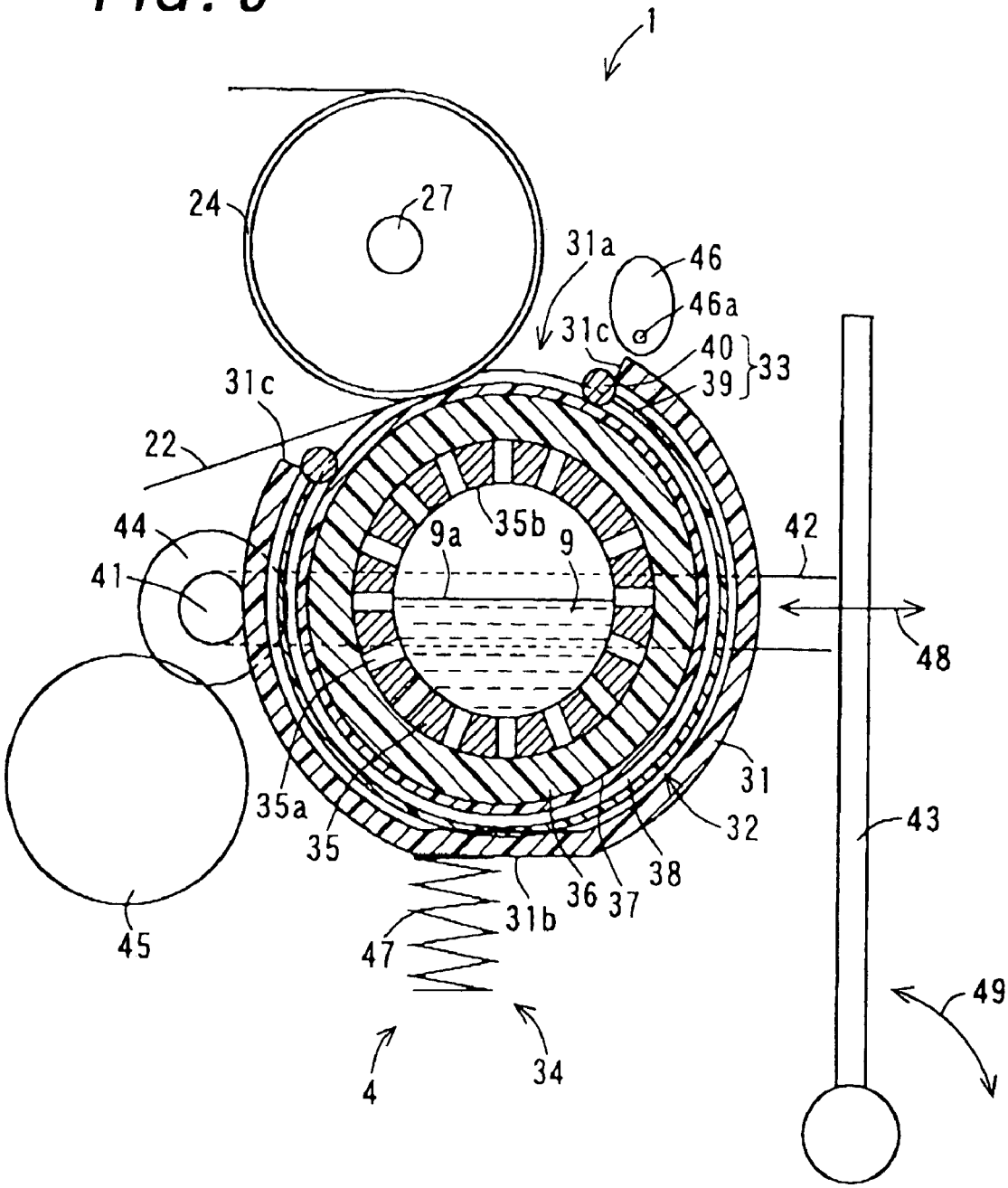
FIG. 3 is an enlarged sectional view showing the structure of the main portion of the image forming apparatus 1 depicted in FIG. 1.

FIG. 1 is a sectional view schematically illustrating the constitution of an image forming apparatus 1 according to a first embodiment of the invention. FIG. 2 is an enlarged sectional view showing the structure of the main portion (a toner image forming section 2 that will be described later) of the image forming apparatus 1 depicted in FIG. 1. FIG. 3 is an enlarged sectional view showing the structure of the main portion (a fixing fluid applying section 4 that will be described later) of the image forming apparatus 1 depicted in FIG. 1. The image forming apparatus 1 is built as a tandem-system electrophotographic image forming apparatus in which toner images of four colors: yellow; magenta; cyan; and black are superimposedly transferred one after another. The image forming apparatus 1 is composed of the toner image forming section 2, an intermediary transfer section 3, the fixing fluid applying section 4, a transferring and fixing section 5, a recording medium supply section 6, and an ejection section 7.

The toner image forming section 2 includes an image forming unit 10*y*, an image forming unit 10*m*, an image forming unit 10*c*, and an image forming unit 10*b*. The image forming units 10*y*, 10*m*, 10*c*, and 10*b* are aligned in a row in this order from the upstream side in a direction in which an intermediary transfer belt 22, which will be described later, is driven to rotate (sub-scanning direction), namely, a direction indicated by arrow 29. In each of the image forming units 10*y*, 10*m*, 10*c*, and 10*b*, an electrostatic latent image is formed on the basis of image data of a predetermined color inputted in the form of digital signal or the like, and a toner having a color corresponding to the electrostatic latent image is supplied to develop the electrostatic latent image into a toner image of the predetermined color. That is, the image forming unit 10*y* is responsible for formation of a toner image corresponding to yellow-color image data; the image forming unit 10*m* is responsible for formation of a toner image corresponding to magenta-color image data; the image forming unit 10*c* is responsible for formation of a toner image corresponding to cyan-color image data; and the image forming unit 10*b* is responsible for formation of a toner image corresponding to black-color image data. The image forming unit 10*y* is composed of a photoreceptor drum 11*y*, a charging roller 12*y*, a light scanning unit 13*y*, a development device 14*y*, and a drum cleaner 15*y*.

The photoreceptor drum 11*y* is constructed of a roller-shaped member which is so supported as to be driven to rotate about its axis by a non-illustrated driving mechanism, the surface of which is provided with a photosensitive layer for forming thereon an electrostatic latent image and thus a toner image. As the photoreceptor drum 11*y*, for example, the one composed of an electrically conductive substrate and a photosensitive layer formed on the surface of the conductive substrate can be used. The conductive substrate may be formed in the shape of a cylinder, a cylindrical column, a sheet, and so forth. Particularly, the use of a cylindrical-shaped conductive substrate is desirable. As the photosensitive layer, for example, an organic photosensitive layer or an inorganic photosensitive layer can be used. For example, the organic photosensitive layer may be formed by laminating together a resin layer containing a charge generating substance and a resin layer containing a charge transporting substance, or formed of a single resin layer containing both the charge generating substance and the charge transporting substance. On the other hand, the inorganic photosensitive layer may be formed of a layer containing one kind or two kinds or more of substances selected among from zinc oxide, selenium, amorphous silicon, and the like. It is possible to interpose an undercoat layer between the conductive substrate and the photosensitive layer, as well as to provide an outer layer on the surface of the photosensitive layer mainly to protect the photosensitive layer. This embodiment employs a 30 mm-diameter photoreceptor drum composed of, as the conductive substrate, an aluminum elementary pipe connected at ground potential (GND) and a 20 μm-thick organic photosensitive layer formed on the surface of the aluminum elementary pipe. Moreover, in this embodiment, the photoreceptor drum 11*y* is driven to rotate in a clockwise direction at a circumferential velocity of 200 mm/s.

The charging roller 12*y* is constructed of a roller-shaped member which is so supported as to be driven to rotate about its axis by a non-illustrated driving mechanism. Thereby, the surface of the photoreceptor drum 11*y* is electrically charged with a predetermined polarity and at a predetermined potential. The charging roller 12*y* receives application of a voltage through a power source connected thereto (not shown in the figure) to discharge electricity. By the discharge action, the surface of the photoreceptor drum 11*y* is electrically charged. In this embodiment, a voltage of −1200 V is applied to the charging roller 12*y* thereby charging the surface of the photoreceptor drum 11*y* at −600 V. Instead of the charging roller 12*y*, any of a brush-type charging device, a charger-type charging device, and a corona charging device such as a scorotron charger can be used.

The light scanning unit 13 applies signal light 13*y* corresponding to the yellow-color image data to the surface of the photoreceptor drum 11*y* that has been electrically charged by the charging roller 12*y*. In this way, an electrostatic latent image corresponding to the yellow-color image data is formed on the surface of the photoreceptor drum 11*y*. For example, the light scanning unit 13 may be realized by using a semiconductor laser. In this embodiment, on the −600 V-charged surface of the photoreceptor drum 11*y* is formed an electrostatic latent image at an exposure potential of −70 V.

The development device 14*y* is composed of a developing roller 16*y*, a developing blade 17*y*, a development chamber 18*y*, and agitating rollers 19*y* and 20*y*. The developing roller 16*y* bears an yellow-color toner 8*y* on its surface. At a location in closest proximity to the photoreceptor drum 11*y* (at a development nip portion), the developing roller 16*y* feeds the yellow-color toner 8*y* to the electrostatic latent image formed on the surface of the photoreceptor drum 11*y*. The developing roller 16*y* constructed of a roller-shaped member is stored inside the development chamber 18*y*. Note that the development chamber 18*y* has an opening 21*y* formed on the surface thereof that faces the photoreceptor drum 11*y*, through which part of the developing roller 16*y* protrudes outward. The developing roller 16*y* is separated by a certain gap from the photoreceptor drum 11*y* and is made rotatable about its axis. Although not shown in the figure, a stationary magnetic pole is disposed inside the developing roller 16*y*. The developing roller 16*y* is driven to rotate in a direction reverse to the direction in which the photoreceptor drum 11*y* is rotated. That is, the surface of the developing roller 16*y* and the surface of the photoreceptor drum 11*y* are driven to move in the same direction at the development nip portion. Moreover, the developing roller 16*y* receives application of a d.c. voltage (development voltage) through a non-illustrated power source connected thereto. In this way, the yellow-color toner 8*y* on the surface of the developing roller 16*y* is fed smoothly to the electrostatic latent image. In this embodiment, the developing roller 16*y* is rotated at a circumferential velocity of 300 mm/s, which is 1.5 times faster than the circumferential velocity of the photoreceptor drum 11*y*. Moreover, the developing roller 16*y* receives application of a development potential of −240 V. The yellow-color toner layer on the surface of the developing roller 16*y* is brought into contact with the photoreceptor drum 11*y* at the development nip portion thereby feeding the yellow-color toner 8*y* to the electrostatic latent image.

The developing blade 17*y* constructed of a platy member has its one end supported by the development chamber 18*y*, and the other end separated by a certain gap from the developing roller 16*y*. Thereby, the yellow-color toner layer borne on the surface of the developing roller 16*y* can be made uniform (layer regulation). The development chamber 18*y* is constructed of a tank-shaped member having an interior space. As has already been described, the opening 21*y* is formed on the surface thereof which faces the photoreceptor drum 11*y*. In the interior space of the development chamber 18*y* are housed, in addition to the yellow-color toner 8*y*, the developing roller 16*y* and the agitating rollers 19*y* and 20*y*. The development chamber 18*y* is replenished with the yellow-color toner 8*y* from a non-illustrated toner cartridge in response to the condition of consumption of the yellow-color toner 8*y*. In this embodiment, the yellow-color toner 8*y* is used in admixture with magnetic carriers as a dual-component developing agent. However, the invention is not limited thereto, and thus the yellow-color toner 8*y* may also be used as a one-component developing agent by itself.

The agitating rollers 19*y* and 20*y* are each constructed of a screw-shaped member designed to be rotatable about its axis. In the interior space of the development chamber 18*y*, the agitating rollers 19*y* and 20*y* are separated by a certain gap from each other. The agitating roller 19*y* is arranged facing the developing roller 16*y*, with a certain gap secured therebetween. As the agitating rollers 19*y* and 20*y* are rotated, so the yellow-color toner 8*y* fed into the development chamber 18*y* from the non-illustrated toner cartridge and magnetic carriers charged inside the development chamber 18*y* in advance are blended together, and the admixture is fed to the region around the developing roller 16*y*.

In this embodiment, the photoreceptor drum 11*y* and the developing roller 16 are arranged in spaced relation to each other, ditto for the developing roller 16*y* and the developing blade 11*y*, the developing roller 16*y* and the agitating roller 19*y*, and the agitating roller 19*y* and the agitating roller 20*y*. However, the invention is not limited thereto, and thus the photoreceptor drum 11*y* and the developing roller 16*y* may also be arranged in pressure-contact with each other, and so are the developing roller 16*y* and the developing blade 17*y*, the developing roller 16*y* and the agitating roller 19*y*, and the agitating roller 19*y* and the agitating roller 20*y*.

As will be described later on, after the yellow-color toner image on the surface of the photoreceptor drum 11*y* is transferred onto the intermediary transfer belt 22, the drum cleaner 15*y* serves to remove and collect the residual yellow-color toner 8*y* remaining on the surface of the photoreceptor drum 11*y*.

According to the image forming unit 10*y*, the surface of the photoreceptor drum 11*y*, now placed in an electrically charged state by the charging roller 12*y*, is irradiated with the signal light 13*y* corresponding to the image data on the yellow-color toner emitted from the light scanning unit 13. In this way, an electrostatic latent image is formed thereon. Then, the yellow-color toner 8*y* is supplied from the development device 14*y* to the electrostatic latent image, whereupon the electrostatic latent image is developed into an yellow-color toner image. As will be described later on, the yellow-color toner image is transferred onto the intermediary transfer belt 22 which is driven to rotate in the direction of arrow 29 while making pressure-contact with the surface of the photoreceptor drum 11*y*. The yellow-color toner 8*y* remaining on the surface of the photoreceptor drum 11*y* is removed and collected by the drum cleaner 15*y*. This image (toner image) forming operation is performed over and over again. The image forming units 10*m*, 10*c*, and 10*b* have basically the same structure as that of the image forming unit 10*y*, the sole difference being the color of toner for use. That is, the image forming units 10*m*, 10*c*, and 10*b* deal with a magenta-color toner 8*m*, a cyan-color toner 8*c*, and a black-color toner 8*b*, respectively. Therefore, such constituent components as are common to those in the image forming unit 10*y* will be identified with the same reference symbols, and yet the reference symbols will be added with suffixes "m", "c", and "b" that indicate magenta, cyan, and black, respectively, instead of "y", case by case. Overlapping descriptions will be omitted accordingly.

The toners of different colors 8*y*, 8*m*, 8*c*, and 8*b* (in the following description, they are collectively called "the toner 8" unless otherwise specified) each contain a binder resin, a coloring agent, and a mold releasing agent.

There is no particular limitation to the binder resin for use so long as it can be swollen or softened by a fixing fluid 9 which will be explained later on. The examples thereof include: polystyrene; a homopolymer of a styrene derivative substitution; a styrene-series copolymer, namely a copolymer of two or more kinds of substances selected among from styrene and its substitution products; polyvinyl chloride; polyvinyl acetate; polyethylene; polypropylene; polyester; and polyurethane. These binder resin materials may be used singly or by way of a combination of two or more kinds. Among them, with consideration given to color toner formation, it is desirable to use a binder resin material which ranges in softening temperature from 100° C. to 150° C. and ranges in glass transition temperature from 50° C. to 90° C. in terms of preservability, durability, and control of the swelling or softening effect produced by the fixing fluid 9. The use of polyester having a softening temperature and a glass transition temperature that each fall in the aforementioned range is particularly desirable. This is because polyester is easily swollen and softened by an easy-to-find organic solvent, and turns out to be transparent in a swollen/softened state. In the case of using polyester as the binder resin, upon a multi-color toner image, which is formed by superimposing toner images of two or more colors selected among from yellow, magenta, cyan, and black, being fixed onto a recording medium by the fixing fluid 9, then polyester per se turns out to be transparent. This makes it possible to attain excellent coloration in accordance with a subtractive color mixing process. Moreover, image fixation using the fixing fluid 9 can be achieved even in the case of using a resin material such as that which is higher in softening temperature or molecular weight than a binder resin to be contained in toner for use in the heat fixing method. The use of a resin material having a higher softening temperature or molecular weight makes it possible to avoid image degradation resulting from application of a load during the course of development, and thereby obtain high-quality images for a longer period of time. Although the use of a resin material having a higher softening temperature or molecular weight does not contribute to satisfactory fixation and coloration in the heat fixing method, in the case of chemically swelling and softening the toner through the application of the fixing fluid 9, its use contributes to high-quality image formation.

As the coloring agent, it is possible to use pigments and dyestuffs adaptable to toner formation that have conventionally been used in electrophotographic image formation. In particular, the use of a pigment material which is insoluble in the fixing fluid 9 is desirable from the standpoint of preventing toner from spreading on a recoding medium when a toner image is transferred and fixed thereon through the application of the fixing fluid 9. The examples of suitable pigments include: in addition to carbon black, organic pigments such as azo-base pigments, benzimidazolone-base pigments, quinacridon-base pigments, phthalocyanine-base pigments, isoindolinone-base pigments, isoindoline-base pigments, dioxazine-base pigments, anthraquinone-base pigments, perylene-base pigments, perynone-base pigments, thioindigo-base pigments, quinophthalone-base pigments, and metal complex-base pigments; inorganic pigments such as titanium oxide, molybdenum red, chrome yellow, titanium yellow, chrome oxide, and Berlin blue; and powdery metal such as aluminum powder. These pigments may be used singly or by way of a combination of two or more kinds.

As the mold releasing agent, for example, a wax can be used. While wax materials used customarily in this field can be used, a wax which is swollen or softened by the fixing fluid 9 is particularly desirable. Specific examples thereof include: a polyethylene wax; a polypropylene wax; and a paraffin wax. This embodiment employs a low-molecular polyethylene wax having a softening temperature of 70° C., which is lower than the softening temperature of the binder resin contained in the toner 8. Therefore, even under the temperature lower than the softening temperature of the binder resin and thus the softening temperature of the toner 8, as the wax is softened, so toner-to-toner adherability and also the adherability of the toner 8 with respect to the toner image carrier and the recording medium P can be increased. Accordingly, during the application of the fixing fluid 9 to the toner image, the occurrence of problems such as undesirable flowing and coagulation of the toner 8 can be avoided. Another advantage is that, as the wax is softened, so the fixing fluid 9 finds its way smoothly into the toner particles through the wax-present part, wherefore the toner 8, in its entirety, can be swollen and softened in a short time during the application of the fixing fluid 9. This makes is possible to attain sufficiently high fixation strength when the toner image is transferred and fixed onto the recording medium P, as well as to achieve good coloration at the time of superposition of toner images.

In addition to the binder resin, the coloring agent, and the mold releasing agent, one kind or two kinds or more of commonly-used toner additives selected among from a charge controlling agent, a flowability enhancer, a fixation accelerator, a conducting agent, and so forth may be contained in the toner 8.

The toner 8 can be produced in accordance with conventionally-known manufacturing methods. For example, according to a pulverization method, the toner 8 is obtained by dispersing the coloring agent, the mold releasing agent, and so forth in the binder resin, and then pulverizing the resultant admixture. According to a polymerization method, the toner 8 is obtained by dispersing evenly the coloring agent, the mold releasing agent, monomer of the binder resin, and so forth, and then polymerizing the binder resin monomer. According to a coagulation method, the toner 8 is obtained by flocculating particles of the binder resin, the coloring agent, the mold releasing agent, and so forth in the presence of a flocculating agent, and then heating the resultant agglomeration. Note that the toner 8 particles should preferably be given indefinite shape rather than full-rounded shape to obtain as large a surface area as possible. This allows easy contact with the fixing fluid 9, wherefore the amount of the fixing fluid 9 to be consumed can be reduced and also toner images can be fixed and dried in a short time. Although the volumetric average particle diameter of the toner 8 is not particularly restricted, preferably it is set to fall in a range of from 2 μm to 7 μm. The use of such a toner having a small particle size makes it possible to increase the surface area of the toner per unit area of toner image, and thereby increase the area of contact with the fixing fluid 9. As a result, the toner 8 can be fixed onto the recording medium P in a short time. By shortening the time taken to complete the fixation, it is possible to achieve a reduction in fixing fluid 9 consumption. Moreover, since the fixing fluid 9 can be dried swiftly, it never occurs that wrinkles, curls, or the like are generated in the recording medium P. Further, when it is assumed that there are toners of the same weight, the one having a smaller particle size than the other will exhibit a higher covering rate with respect to the recording medium P. That is, the smaller is the particle size of the toner 8, the more likely it is that a high-quality image can be formed with a smaller amount of the adherent toner 8. This makes it possible to satisfy conflicting requirements: a reduction in toner consumption and enhancement of image quality. This embodiment employs, as the toner 8, an insulative non-magnetic toner which is negatively charged, has a volumetric average particle diameter of 6 μm, and exhibits a contact angle of 47 degrees with respect to the fixing fluid 9, wherein the coloring agent content and the wax content are adjusted to be 12% and 7%, by weight, respectively, relative to the total amount of the toner 8, and the remainder is polyester (binder resin) having a glass transition temperature of 90° C. and a softening temperature of 120° C. In order to obtain a predetermined image density (1.4: a reflection density value measured by a reflection densitometer type 310 manufactured by X-Rite Corporation), it is necessary to use the toner 8 in an amount of 5 g/m$^2$ per unit area.

The intermediary transfer section 3 is composed of the intermediary transfer belt 22, intermediary transfer rollers 23*y*, 23*m*, 23*c*, and 23*b*, supporting rollers 24, 25, and 26, a belt cleaner 28, and a temperature detecting section 30.

The intermediary transfer belt 22 acting as a toner image bearing section is designed as an endless belt stretched across the supporting rollers 24, 25, and 26 for forming a loop-like traveling path. The intermediary transfer belt 22 is driven to rotate in the direction of arrow 29 at a circumferential velocity which is substantially equal to that of the photoreceptor drum 11*y*, 11*m*, 11*c*, 11*b*. There is no particular limitation to the structure of the intermediary transfer belt 22 so long as it is made impervious to the fixing fluid 9. For example, the intermediary transfer belt 22 may be constructed of a laminated body composed of a film-shaped substrate, an elastic resin layer formed on the surface of the film-shaped substrate, and a fluorine resin-containing cover layer formed on the surface of the elastic resin layer. In this case, the surface of the cover layer acts as a toner image bearing surface 22*a*. As the film-shaped substrate, for example, it is possible to use a resin material such as polyimide and polycarbonate, or a rubber material such as fluorine rubber formed in the shape of film. The fluorine resin-containing cover layer is made to contain fluorine resin such as PTFE (polytetrafluoroethylene), PFA (tetrafluoroethylene-perfluoroalkylvinylether copolymer), and an admixture thereof. One of the film-shaped substrate, the elastic resin layer, and the fluorine resin-containing cover layer, or two or more of them, may contain an electrically conductive substance to effect adjustment of the value of electrical resistance suitably for the intermediary transfer belt 22. As the electrically conductive substance, for example, furnace type black, thermal type black, channel type black, and graphite carbon can be used. The intermediary transfer belt 22 is not limited to the belt shape but may be of another shape, for example, a drum shape. This embodiment employs, as the intermediary transfer belt 22, a belt-shaped laminated body obtained by forming, on a surface of a 100 μm-thick polyimide film, a 300 μm-thick silicone rubber layer and a 20 μm-thick fluorine resin-containing cover layer successively. The fluorine resin-containing cover layer is made of a fluorine resin composition in which PTFE and PFA are contained at a ratio of 8:2 (ratio by weight), and an angle of contact with the fixing fluid 9 is set at 70 degrees. In this way, with the intermediary transfer belt 22 constructed of a material which is impervious to the fixing fluid 9, most part of the fixing fluid 9 to be applied can be adhered to the surface of the toner 8. This makes it possible to avoid generation of wrinkles, curls, or the like resulting from the permeation of the fixing fluid 9 into the recording medium P, as well as to achieve a reduction in fixing fluid 9 consumption. The toner image bearing surface 22*a* of the intermediary transfer belt 22 is, from the upstream side in its rotating direction (in the direction of arrow 29), brought into pressure-contact with the photoreceptor drums 11*y*, 11*m*, 11*c*, and 11*b* one after another in the order named. At the location where the intermediary transfer belt 22 is brought into pressure-contact with the photoreceptor drum 11*y*, 11*m*, 11*c*, 11*b*, a toner image of corresponding color is transferred onto the intermediary transfer belt 22 (an intermediary transfer nip portion).

The intermediary transfer rollers 23*y*, 23*m*, 23*c*, and 23*b* each constructed of a roller-shaped member are arranged facing the photoreceptor drums 11*y*, 11*m*, 11*c*, and 11*b*, respectively, with the intermediary transfer belt 22 lying therebetween. The intermediary transfer rollers 23*y*, 23*m*, 23*c*, and 23*b* are brought into pressure-contact with the surface of the intermediary transfer belt 22 opposite to the toner image bearing surface 22*a*, and are rotated about their axes. For example, the intermediary transfer rollers 23*y*, 23*m*, 23*c*, and 23*b* are each constructed of a roller-shaped member composed of a metal-made shaft body having its surface covered with an electrically conductive layer. The shaft body is made of a metal material, for example, stainless steel. Although the diameter of the shaft body is not particularly restricted, preferably it is set to fall in a range of from 8 mm to 10 mm. The electrically conductive layer, which is provided to apply a high voltage to the intermediary transfer belt 22 evenly, is made of a conductive elastic element, for example. As the conductive elastic element, those used customarily in this field can be used. For example, it is possible to use a conductive elastic element obtained by dispersing a conductive substance (e.g. carbon black) in a matrix such as ethylene propylene diene rubber (EPDM), foamed EPDM, and foamed urethane. In order for toner images formed on the surfaces of the photoreceptor drums 11*y*, 11*m*, 11*c*, and 11*b* to be transferred onto the Intermediary transfer belt 22, an intermediary transfer bias of a polarity reverse to the polarity of the charged toner is impressed on the intermediary transfer rollers 23*y*, 23*m*, 23*c*, and 23*b* under constant-voltage control. In this way, the toner images of different colors: yellow; magenta; cyan; and black formed on the photoreceptor drums 11*y*, 11*m*, 11*c*, and 11*b*, respectively, are superimposedly transferred to the intermediary transfer nip portion on the toner image bearing surface 22*a* of the intermediary transfer belt 22 one after another, whereupon a multi-color toner image is formed. Note that, in a case where only part of the yellow-color image data, the magenta-color image data, the cyan-color image data, and the black-color image data is inputted, of the image forming units 10*y*, 10*m*, 10*c*, and 10*b*, only the one/ones corresponding to the input image data is/are operated to achieve toner image formation.

The supporting roller 24 is provided to be rotatable about its axis by a non-illustrated driving mechanism. The supporting rollers 25 and 26 are made rotatable freely about their axes. In cooperation with the supporting rollers 24, 25 and 26 for stretching the intermediary transfer belt 22, the intermediary transfer belt 22 is driven to rotate in the direction of arrow 29. For example, the supporting rollers 24, 25, and 26 are each constructed of an aluminum-made pipe-shaped roller which is 30 mm in diameter and 1 mm in wall thickness. The supporting roller 24 has heating section 27 disposed interiorly thereof and thus serves also as a heating roller. The heating section 27 is operated under the control unit 130, which acts as a control section for controlling all of the workings of the image forming apparatus 1, in response to a detection result as to the temperature of the intermediary transfer belt 22 produced by the temperature detecting section 30 located downstream from the supporting roller 24 in the direction in which the intermediary transfer belt 22 is driven to rotate. The details of the control over the heating section 27 will be explained later on.

It is preferable that a toner image is heated by the heating section 27 to a temperature which is equal to or higher than the glass transition temperature of the binder resin contained in the toner 8 constituting the toner image. In this case, as the binder resin is softened, so the toner 8-to-toner 8 adherability and the adherability between the toner 8 and the intermediary transfer belt 22 can be increased. Accordingly, when the fixing fluid 9 is provided by a subsequently-described coating roller 32, it never occurs that the toner 8 is offset with respect to the coating roller 32 and that the toner image suffers from irregularity. This makes it easy for the coating roller 32 to apply the fixing fluid 9 to the toner image in a contact manner. This embodiment employs the toner 8 which contains a binder resin having a glass transition temperature of 90° C. Moreover, the temperature of the intermediary transfer belt 22 is adjusted to be kept at 100° C., which is higher than the glass transition temperature of the binder resin contained in the toner 8. By exercising temperature control in that way, the toner image formed on the intermediary transfer belt 22 can be heated to substantially the same temperature as that of the intermediary transfer belt 22 when passing through the surface of the supporting roller 24. Then, as the binder resin is softened, so the toner 8-to-toner 8 adherability and the adherability between the toner 8 and the intermediary transfer belt 22 can be increased. This helps prevent, for example, the offset of the toner 8 with respect to the coating roller 32 and toner image irregularity. As a result, the fixing fluid 9 can be applied to the surface of the toner image smoothly in a contact manner by the coating roller 32.

Note that, when the faxing fluid 9 is provided in a contact manner by the subsequently-described coating roller 32, the intermediary transfer belt 22 and the toner image formed thereon undergo a drop in temperature due to the application of the fixing fluid 9. At this time, a certain amount of heat is generated to make up for the decrease of temperature, wherefore the toner 8 constituting the toner image can be swollen and softened more smoothly. Moreover, the heating section 27 is adjusted to function only when the intermediary transfer belt 22 is being driven to rotate. The heating section 27 is disposed for the purpose of assisting the fixing fluid 9 to effect toner image fixation and achieving a further reduction of fixing fluid 9 consumption. Therefore, the heating section 27 does not have to be designed to produce heat to the extent necessary to achieve thermal fixation of toner images. That is, even if the heating section 27 is disposed, the image forming apparatus 1 consumes far less power than does a typical image forming apparatus that adopts the heat fixing method. For example, a halogen lamp may be used as the heating section 27. The supporting roller 25 is electrically connected to ground, and serves also as a backup roller for image transference and fixation to be effected in the subsequently-described transferring and fixing section. The supporting roller 26 serves as a tension roller for imparting a tension to the intermediary transfer belt 22.

After the toner image on the toner image bearing surface 22*a* of the intermediary transfer belt 22 is transferred onto the recording medium P in the subsequently-described transferring and fixing section 5, the belt cleaner 28 removes the residual toner remaining on the toner image bearing surface 22*a*. The belt cleaner 28 is composed of a cleaning blade 28*a* and a toner vessel 28*b*. The cleaning blade 28*a* is arranged in confrontation with the supporting roller 26, with the intermediary transfer belt 22 lying therebetween, and is brought into pressure-contact with the toner image bearing surface 22*a* by a non-illustrated pressurizing section. The cleaning blade 28*a* is constructed of a platy member so as to scrape off residual toner, paper powder, and so forth present on the toner image bearing surface 22*a*. For example, a blade made of a rubber material such as urethane rubber may be used as the cleaning blade 28*a*. The toner vessel 28*b* stores therein the residual toner, offset toner, paper powder, and so forth scraped off by the cleaning blade 28*a*.

The temperature detecting section 30 detects the temperature of the intermediary transfer belt 22. The result detected by the temperature detecting section 30 is transmitted to the control unit 130 for controlling all of the workings of the image forming apparatus 1. The control unit 130 is provided with a storage section, a calculation section, and a control section. The result detected by the temperature detecting unit 30 is inputted to the storage section. The storage section receives in advance input of data on a certain temperature (controlled temperature) determined for the intermediary transfer belt 22 on the basis of physical property data such as the softening temperatures of the binder resin and the mold releasing agent contained in the toner 8. In the calculation section of the control unit 130, a comparison is made between the result detected by the temperature detecting section 30 and the controlled temperature of the intermediary transfer belt 22. When the calculation result shows that the temperature detected by the temperature detecting section 30 is lower than the controlled temperature, then the control unit controls the control section in a manner so as to send a control signal to the power source of the heating section 27 to raise the temperature of the intermediary transfer belt 22. On the other hand, when the calculation result shows that the detected temperature is higher than the controlled temperature, then the control unit controls the control section in a manner so as to send a control signal to the heating section 27 to stop its heating operation. In this embodiment, a temperature sensor is used as the temperature detecting section 30.

According to the intermediary transfer section 3, the toner images of different colors formed on the photoreceptor drums 11*y*, 11*m*, 11*c*, and 11*b* are superimposedly transferred to the intermediary transfer nip portion on the toner image bearing surface 22*a* of the intermediary transfer belt 22 one after another, whereupon a toner image is formed. The toner image thus formed is subjected to the application of the fixing fluid 9 by the fixing fluid applying section 4, and is then transferred onto the recording medium P by the transferring and fixing section 5. After that, residues such as toner remaining on the toner image bearing surface 22*a* of the intermediary transfer belt 22 are removed by the belt cleaner 28 in preparation for subsequent toner image transference on the toner image bearing surface 22*a*.

In the fixing fluid applying section 4, the fixing fluid 9 is applied to a toner image on the toner image bearing surface 22*a* of the intermediary transfer belt 22 in a contact manner thereby softening and/or swelling the toner image. By designing the fixing fluid applying section 4 to apply the fixing fluid 9 in a contact manner, it is possible to apply the fixing fluid 9 also to a so-called fogged toner which is adhered to an image-free region (non-image region) and thus fix the fogged toner into place. This helps prevent the adhesion of the fogged toner to user's hands or clothing, for example. Note that the amount of the fogged toner is so minute that the fixation of the fogged toner onto the recording medium P exerts little influence upon a resultant image.

In reference to FIG. 3, the fixing fluid applying section 4 is composed of a fixing fluid chamber 31, the coating roller 32, a second seal member 33, and contact and release operation section 34. The fixing fluid applying section 4 is characterized in that the fixing fluid 9 is stored inside the coating roller 32 and that at least the coating roller 32, the fixing fluid chamber 31, and the second seal member 33 are integrated in the form of a cartridge which is freely attachable to and detachable from the image forming apparatus 1.

In the case of designing a combination of at least the fixing fluid chamber 31, the coating roller 32, and the second seal member 33 in the form of a cartridge, when the fixing fluid 9 stored inside the coating roller 32 becomes totally depleted, the replenishment of the fixing fluid 9 can be effected simply by replacing the cartridge with the new one. Since there is no need to handle the fixing fluid 9 in liquid form at the time of replenishment, it never occurs that the image forming apparatus 1 is interiorly contaminated with splashes of the fixing fluid 9. For example, the cartridge is detachably disposed in a direction perpendicular to the rotary shaft of the coating roller 32 (a horizontal direction). This helps prevent the coating roller 32 and the intermediary transfer belt 22 from rubbing against each other that will lead to damage during the attachment or detachment of the cartridge. Moreover, the cartridge is attached and detached, with an open/close gate 43 left opened. The open/close gate 43 is disposed on a side face 1*a* of the image forming apparatus 1 so as to be opened and closed freely. Since the fixing fluid 9 is stored inside the coating roller 32, it is possible to make the fixing fluid applying section 4 compact and thus allow easy attachment and detachment to and from the image forming apparatus 1. Further, by virtue of the second seal member 33 disposed in contact with the surface of the coating roller, for example, vaporization of the fixing fluid 9 from the surface of the coating roller 32 and leakage of the fixing fluid 9 from the fixing fluid chamber 31 can be prevented.

In the fixing fluid chamber 31, when mounted in the image forming apparatus 1, a surface constituting its bottom (a bottom face 31*b*) is flat-shaped, whereas the other surfaces are made to have a curvature. On the whole, the fixing fluid chamber 31 is designed as a vessel-shaped member having substantially the shape of cylinder. The fixing fluid chamber 31 has an opening 31*a* formed on the surface thereof that faces the intermediary transfer belt 22. The coating roller 32 is placed in the interior space of the fixing fluid chamber 31 in such a way as to be supported rotatably. Although there is no particular limitation to the materials of construction of the fixing fluid chamber 31, for example, synthetic resin or metal can be used. The fixing fluid chamber 31 has a pivot 41 formed integrally therewith. Specifically, the pivot 41 is formed on the outer peripheral surface of the fixing fluid chamber 31 at a position below the opening 31*a* and facing the temperature detecting section 30. The pivot 41 is slidably inserted into a U-shaped guide groove 42 formed on the fixing fluid chamber 31-facing side face of the open/close gate 43 disposed on the side face 1*a* of the image forming apparatus 1 so as to be opened and closed freely in a direction indicated by arrow 49. As the pivot 41 slides along the guide groove 42, so the fixing fluid chamber 31 is moved in a direction indicated by arrow 48, thus allowing attachment and detachment of the fixing fluid chamber 31. When the pivot 41 is located at the front end of the guide groove 42, the coating roller 32 stands at a position to dip with the intermediary transfer belt 22 (a working position). Moreover, a press spring 47 abuts against the bottom face 31*b* of the fixing fluid chamber 31. The press spring 47 has its one end pressed against the fixing fluid chamber 31, and the other end supported by the main body of the image forming apparatus 1. Thereby, the fixing fluid chamber 31 can be pressed to move upward in the vertical direction. At this time, the fixing fluid chamber 31 is so supported as to be movable rotationally about the pivot 41, and thereby the coating roller 32 accommodated inside the fixing fluid chamber 31 is brought into contact with the intermediary transfer belt 22 under a predetermined light press force. The press force required for the pressure contact can be adjusted by making a change to the type of the press spring 47 or otherwise. As the press spring 47, for example, a coil spring, a leaf spring, and a torsion spring can be used.

The coating roller 32 is constructed of a roller-shaped member, part of which protrudes outward through the opening 31*a* formed on the intermediary transfer belt 22-facing surface of the fixing fluid chamber 31, and is thus allowed to move to contact and release from the intermediary transfer belt 22. The coating roller 32 is composed of a metal core 35, a permeation control layer 36 formed on the surface of the metal core 35, and a porous layer 37 formed on the surface of the permeation control layer 36. The coating roller 32 also has a flange formed at both ends in its lengthwise direction so as to merge into the metal core 35. The rotary shaft of the coating roller 32, which is formed integrally with the flanges, is supported on a non-illustrated bearing disposed inside the fixing fluid chamber 31. With this construction, the coating roller 32 is rotatably supported by the fixing fluid chamber 31. By designing the coating roller 32 in roller configuration, it is possible to create a closed space within the coating roller 32, and thereby allow easy storage and retention of the fixing fluid 9.

As the metal core 35, those used customarily in this field can be used. This embodiment employs an aluminum-made core bar which is 30 mm in outer diameter and 0.5 mm in wall thickness. Moreover, the metal core 35 has formed therein a plurality of through holes for allowing passage of the fixing fluid 9 as fixing fluid supply holes 35*a*. In this embodiment, 16 pieces of 0.1 mm-diameter fixing fluid supply holes 35*a* are arranged at equal angles to each other in a direction circumferentially of the metal core 35. The fixing fluid supply holes 35*a* are spaced 5 mm apart, with the adjacent ones relatively shifted by half a phase in a direction axially of the metal core 35. The inner part of the metal core 35 constitutes a fixing fluid storage chamber for storing the fixing fluid 9. That is, the metal core 35 serves not only to increase the rigidity of the coating roller 32, but also to function as a fixing fluid storage layer. In this way, since the fixing fluid 9 is stored inside the metal core 35, it is possible to downsize the constituent components of the fixing fluid applying section 4, considered collectively as a unit, and thus allow easy attachment and detachment to and from the main body of the image forming apparatus 1. The fixing fluid 9 stored inside the metal core 35 is fed through the fixing fluid supply holes 35*a* to the permeation control layer 36 formed on the surface of the metal core 35.

As the fixing fluid 9 to be stored inside the metal core 35, those containing a liquid component capable of swelling and softening the binder resin, the mold releasing agent, and so forth contained in the toner 8 can be used. In particular, the use of an admixture of water and one kind or two kinds or more of organic solvents is desirable. As the organic solvent, a component such as that which is able to swell and soften the binder resin, the mold releasing agent, and so forth and is dissoluble or dispersible in water can be used. The examples thereof include: alcohol group-components (e.g. methyl alcohol, ethyl alcohol, propyl alcohol, butyl alcohol, octyl alcohol, decyl alcohol, diethylene glycol, glycerin, polyethylene glycol, phenol, benzyl alcohol, and methyl benzyl alcohol); ketone group-components (e.g. acetone, methyl ethyl ketone, methyl butyl ketone, methyl isobutyl ketone, and diethyl ketone); ether group-components (e.g. methyl ethyl ether, diethyl ether, methyl butyl ether, methyl isobutyl ether, dimethyl ether, diisopropyl ether, and octyl phenyl ether); and ester group-components (e.g. methyl acetate, ethyl acetate, ethyl oleate, ethyl acrylate, methyl methacrylate, dibutyl succinate, diethyl phthalate, diethyl tartrate, ethyl palmitate, and dioctyl phthalate). Among them, ether group-components and ester group-components are preferably used, and the selection of ester group-components is optimal. These organic solvent components are excellent at swelling and softening the binder resin, typified by polyester, contained in the toner 8. The organic solvent components may be used singly or by way of a combination of two or more kinds.

The content of water in the fixing fluid 9 should preferably fall in a range of from 20% to 95% by weight, and more preferably from 30% to 90% by weight, relative to the total amount of the fixing fluid 9. On the other hand, the content of organic solvent in the fixing fluid 9 should preferably fall in a range of from 5% to 80% by weight, and more preferably from 10% to 70% by weight, relative to the total amount of the fixing fluid 9. The aforementioned ranges of content ratio are ideal for effecting the swelling and softening of the binder resin contained in the toner 8. If the water content is greater than 95% by weight, the effect of swelling and softening the toner 8 produced by the fixing fluid 9 is so low that sufficiently high fixation strength cannot be attained. By contrast, if the water content is less than 20% by weight, the permeability of the fixing fluid 9 with respect to a toner image is so low that, where the recording medium P has transferred thereon an unfixed toner image which is high in toner amount, only the toner portion of the top-surface layer of the toner image can be swollen and softened, and the toner portion of the lower-surface layer of the toner image contacted by the recording medium P cannot be swollen and softened properly. This makes it impossible to fix the toner image onto the recording medium P with sufficiently high fixation strength.

In addition to water and the organic solvent, the fixing fluid 9 may contain a surfactant. For example, the addition of a surfactant helps enhance the dispersibility of the organic solvent in the fixing fluid 9 and thus the wettability between the fixing fluid 9 and the toner 8. The examples of usable surfactants include: negative ion (anion) surfactants (e.g. higher alcohol sulfuric ester salt such as lauryl sulfate ester sodium salt, higher fatty acid metal salt such as sodium oleate, fatty acid derivative sulfuric ester salt, and phosphoric ester); positive ion (cation) surfactants (e.g. quaternary ammonium salt and heterocyclic amine); amphoteric ion (nonion) surfactants (e.g. amino acid ester and amino acid); nonionic surfactants; polyoxyalkylenealkyl ether; and polyoxy ethylene alkyl amine. These surfactant components may be used singly or by way of a combination of two or more kinds. The fixing fluid 9 may further contain a dispersion aid, for example, a coupling agent such as diethylene glycol, triethylene glycol, polyethylene glycol, monobutyl ether, and diethylene glycol monomethyl ether.

The fixing fluid 9 exhibits volatility. A vapor pressure as observed at a temperature of 20° C. is taken as an index of the volatility of the fixing fluid 9. The vapor pressure of the fixing fluid 9 preferably stands at 0.005 MPa or above, and more preferably falls in a range of from 0.005 MPa to 0.028 MPa, at 20° C. By adjusting the vapor pressure in the aforementioned range, it is possible for the fixing fluid 9 to be dried in a short time, and thereby increase the number of output to be produced from the image forming apparatus 1 per unit of time. Specifically, for example, even if recording media bearing images are put out successively at a throughput rate of 40 pieces/min., it never occurs that, between the recording media produced one after the other, the toner image, the toner 8, and the fixing fluid 9 of the recording medium produced earlier are adhered to the one produced later. If the vapor pressure of the fixing fluid 9 exceeds 0.028 MPa, the fixing fluid 9 is dried so fast that it becomes difficult to apply the fixing fluid 9 in an amount required for fixation to a toner image with stability. Furthermore, the fixing fluid 9 keeps evaporating from the surface of the coating roller 32 during the course of application, which results in a useless increase in fixing fluid 9 consumption. On the other hand, if the vapor pressure of the fixing fluid 9 is equal to atmospheric pressure, the fixing fluid 9 is brought to a boil and evaporates instantaneously. By using the fixing fluid 9 having a vapor pressure falling within the aforementioned range, it is possible for the image forming apparatus 1 to produce output of images at high speed and with stability, as well as to achieve a reduction in fixing fluid 9 consumption and thus a reduction in the number of supply of the fixing fluid 9 to the image forming apparatus 1. Moreover, in the case of disposing a storage tank for storing the fixing fluid 9 within the image forming apparatus 1, the storage tank can be made compact.

The fixing fluid 9 employed in this embodiment is such that a contact angle which the intermediary transfer belt 22 makes with the fixing fluid 9 is 70 degrees, a contact angle which the porous layer 37 of the coating roller 32 makes therewith is 65 degrees, and a contact angle which the toner 8 makes therewith is 47 degrees.

The permeation control layer 36 formed on the surface of the metal core 35 is provided to avoid that the metal core 35 and the porous layer 37 makes direct contact with each other that will eventually cause an excess amount of the fixing fluid 9 to be fed to the porous layer 37. The permeation control layer 36 is made of an elastically deformable material which allows permeation and retention of the fixing fluid 9. With the construction in which the permeation control layer 36 is interposed between the metal core 35 and the porous layer 37, it is possible to avoid that, when the coating roller 32 is brought into pressure-contact with the intermediary transfer belt 22, an excess amount of the fixing fluid 9 is adhered to the surface of the coating roller 32 and builds up at the entrance of a pressure-contact nip portion between the coating roller 32 and the intermediary transfer belt 22 that will eventually cause a so-called meniscus phenomenon. As a result, it never occurs that the fixing fluid 9 flows vigorously with the fixing fluid 9 and the toner image kept in contact with each other, in consequence whereof there results no irregularity in the toner image. That is, an image of high quality and high resolution can be produced. The permeation control layer 36 retains the fixing fluid 9 at its minute pores existing therein. The pores become elastically deformed, together with the porous layer 37, in conformity with the surface condition of a target object kept in contact with the coating roller 32. In a case where the object on contact has a relatively smooth surface, the degree of the elastic deformation is low, and thus the amount of the fixing fluid 9 squeezed out of the pores under the elastic deformation is small. That is, from a macroscopic standpoint, the amount of application of the fixing fluid 9 per unit area is small. On the other hand, in a case where the object on contact is a multi-color toner image having large asperities, the degree of the elastic deformation of the pore is high, and thus the amount of the fixing fluid 9 squeezed out of the pores is large. That is, from a macroscopic standpoint, the amount of application of the fixing fluid 9 per unit area is large. In this way, the amount of application of the fixing fluid 9 is controlled by the permeation control layer 36.

Being kept in contact with the metal core 35, the permeation control layer 36 is able to receive supply of a sufficient amount of the fixing fluid 9. For example, the permeation control layer 36 is made of a felt or a rubber material of open-celled foam (sponge). This embodiment employs a 5 mm-thick felt. Moreover, in this embodiment, the permeation control layer 36 is designed to exhibit a Young's modulus (taken as an index of elasticity) of 3 MPa. This value is only 1/100 or below of the Young's modulus of the toner 8. Since the material constituting the permeation control layer 36 such as a felt, an open-celled rubber (e.g. sponge) has the function of retaining the fixing fluid 9, even if the layer thickness of the porous layer 37 is reduced and the amount of the fixing fluid 9 retained therein is reduced correspondingly, it is possible to apply a sufficient amount of the fixing fluid 9 to the toner image formed on the intermediary transfer belt 22. Accordingly, by reducing the thickness of the porous layer 37 made of an expensive porous membrane, as well as composing the inner permeation control layer 36 of an inexpensive material such as an open-celled rubber or a felt, it is possible to achieve a reduction in cost for producing the coating roller 32.

By the porous layer 37, the fixing fluid 9 fed from the permeation control layer 36 is applied to the toner image on the toner image bearing surface 22*a* of the intermediary transfer belt 22 in a contact manner. The porous layer 37 includes a multiplicity of minute pores capable of retaining the fixing fluid 9. A characteristic of the porous layer 37 is that it absorbs the fixing fluid 9 existing in the vicinity of the surface thereof when its amount is large, but emits the fixing fluid 9 when its amount is small. Accordingly, it never occurs that the fixing fluid 9 builds up at the entrance of the nip portion between the coating roller 32 and the intermediary transfer belt 22 that will eventually cause a meniscus. As a result, the toner image is free from irregularity caused by the flowing action of the fixing fluid 9, wherefore an image of high quality and high resolution can be produced.

Moreover, since the porous layer 37 receives supply of the fixing fluid 9 from the permeation control layer 36 without delay in response to the condition of consumption of the fixing fluid 9, even if solid images which are thick with toner are outputted one after another, images in a properly-fixed state can be obtained with stability. There is no particular limitation to the material used to form the porous layer 37 so long as it can be elastically deformed and made to have a porous structure. For example, PTFE, polyurethane, and polyimide can be used. The conditions to be fulfilled by the porous layer 37 such as a material for use, a pore diameter, and a porosity can be selected arbitrarily in accordance with the composition of the fixing fluid 9. Although the pore diameter of the porous layer 37 is not particularly restricted, preferably it is set to fall in a range of from 0.1 μm to 2 μm. If the pore diameter is less than 0.1 μm, the amount of permeation of the fixing fluid 9 becomes so small that that part of the toner image which is high in toner amount cannot be fixed with high fixation strength. By contrast, if the pore diameter is greater than 2 μm, the particles of the toner 8 get caught and stuck firmly in the pore, which results in the occurrence of clogging in the porous layer 37. Moreover, although the porosity of the porous layer 37 is not particularly restricted, preferably it is set to fall in a range of from 60% to 90%. If the porosity is less than 60%, the amount of the fixing fluid 9 to be retained and permeated becomes so small that that part of the toner image which is high in toner amount cannot be fixed with high fixation strength. By contrast, if the porosity is greater than 90%, it becomes difficult to design the porous layer 37 as a shape-recoverable, elastically deformable layer. Further, although the layer thickness of the porous layer 37 is not particularly restricted, preferably it is set to fall in a range of from 10 μm to 200 μm. If the layer thickness is less than 10 μm, it becomes difficult to create the desired porous layer 37. By contrast, if the layer thickness is greater than 200 μm, the amount of permeation of the fixing fluid 9 becomes so small that that part of the toner image which is high in toner amount cannot be fixed with high fixation strength.

It is preferable that the porous layer 37 is designed to be smaller in angle of contact with the fixing fluid 9 than the toner image bearing surface 22*a* of the intermediary transfer belt 22. In this case, upon contact between the porous layer 37 and the intermediary transfer belt 22, the porous layer 37 permits the fixing fluid 9 to be preferentially adhered thereto. This makes it possible to reduce the amount of the fixing fluid 9 which is applied through the porous layer 37 to the non-image region free of toner adhesion on the intermediary transfer belt 22, and thereby achieve a reduction in fixing fluid 9 consumption and thus a reduction in the number of supply of the fixing fluid 9. The difference in contact angle between the porous layer 37 and the intermediary transfer belt 22 should preferably be set at or above 5 degrees. It is also preferable that the porous layer 37 is designed to be larger in angle of contact with the fixing fluid 9 than the toner 8. In this case, upon contact between the porous layer 37 and the toner image, the toner image permits the fixing fluid 9 to be preferentially adhered thereto. This makes it possible to apply a sufficient amount of the fixing fluid 9 through the porous layer 37 to the toner image, namely an image region. As a result, that part of the toner image which is high in toner amount on a per-unit-area basis can also be fixed with sufficiently high fixation strength. The difference in contact angle between the porous layer 37 and the toner 8 should preferably be set at or above 10 degrees. In this embodiment, the porous layer 37 is formed of a 50 μm-thick PTFE layer, the pore diameter and the porosity of which are set at 0.5 μm and 80%, respectively. Moreover, in this embodiment, the contact angle of the porous layer 37 with respect to the fixing fluid 9 is set at 65 degrees.

It is preferable that the coating roller 32 having the above-described structure is designed to dip lightly with the intermediary transfer belt 22 under a predetermined press force when the fixing fluid 9 is applied to the toner image formed on the intermediary transfer belt 22. In this case, even if a large-area solid image which is thick with toner enters a location where the intermediary transfer belt 22 and the coating roller 32 make pressure-contact with each other (a fixing fluid nip portion), since an adequate interval can be secured between the coating roller 32 and the intermediary transfer belt 22, a layer of the fixing fluid 9 on the surface of the coating roller 32 is allowed to pass through the fixing fluid nip portion. As a result, the coating roller 32 is brought into pressure-contact with the intermediary transfer belt 22, with the lamellar fixing fluid 9 lying therebetween. This makes it possible to apply a sufficient amount of the fixing fluid 9 to the toner image. Moreover, it never occurs that the fixing fluid 9 builds up at the entrance of the fixing fluid nip portion that will eventually cause a large meniscus. Accordingly, the fixing fluid 9 is inhibited from flowing greatly in contact with the toner image, in consequence whereof there results no irregularity in the toner image. That is, an image of high quality and high resolution can be produced. Further, since the toner image and the coating roller 32 makes contact with each other with the fixing fluid 9 lying therebetween, the direct contact between the toner 8 constituting the toner image and the coating roller 32 is avoidable. This helps prevent the adhesion of the toner 8 to the coating roller 32. Although the press force under which the coating roller 32 is brought into contact with the intermediary transfer belt 22 is not particularly restricted so long as the above-described effects can be achieved, preferably it is set to fall in a range of from 0.05 N/cm to 1.0 N/cm in terms of line pressure. If the press force is less than 0.05 N/cm, the contact between the coating roller 32 and the intermediary transfer belt 22 becomes unstable, and thus the fixing fluid 9 cannot be applied evenly to the toner image formed on the intermediary transfer belt 22. Furthermore, the coating roller 32 fails to deform elastically in conformity with the subtle asperities of the intermediary transfer belt 22 and with the asperities of the toner image, wherefore the fixing fluid 9 cannot be applied sufficiently to the concavities of the toner image. This leads to lack of uniformity in the application of the fixing fluid 9 and thus to uneven fixation, which results in unevenness in glossiness and coloration in a resultant image. By contrast, if the press force is greater than 1.0 N/cm, the fixing fluid 9 on the surface of the coating roller 32 is not allowed to pass through the fixing fluid nip portion while the coating roller 32 and the intermediary transfer belt 22 are being rotated in a pressure-contact state. Therefore, the fixing fluid 9 is squeezed into a meniscus at the entrance of the fixing fluid nip portion, and an excess of the fixing fluid 9 flows back toward the upstream side in the direction in which the coating roller 32 is rotated. As a result, the fixing fluid 9 flows vigorously at the entrance of the fixing fluid nip portion, which results in the occurrence of irregularity in the toner image. In this embodiment, the press force under which the coating roller 32 is brought into contact with the intermediary transfer belt 22 is set at 0.1 N/cm, and the coating roller 32 is driven to rotate following the rotation of the intermediary transfer belt 22.

Moreover, being made of an elastic material, the surface of the coating roller 32 is elastically deformable in conformity with the asperities of the toner image. In the region where the toner image is present, the coating roller 32 is brought into pressure-contact with the toner image, with a lamellar fixing fluid 9 lying therebetween. This allows, even if the amount of toner varies from part to part in the toner image, the fixing fluid 9 to be applied evenly to the entire toner image irrespective of the presence of a high-level part and a low-level part. That is, even a multi-color toner image in which the amount of toner varies greatly from part to part can be fixed uniformly, wherefore a high-quality image can be produced. It is preferable that the coating roller 32 is made smaller in elasticity coefficient than the toner 8. Specifically, the elasticity coefficient of the coating roller 32 should preferably be equal to or less than 1/10, and more preferably 1/100, of that of the toner 8. Note that, in a multi-color toner image obtained by superimposing toner images of two or more colors, points of high toner amount and points of low toner amount are involved with one another as if to form a fine distribution, and also the multi-color toner image bears a larger amount of toner as a whole. For example, when a comparison is made between a part of low density in a monochromatic toner image and a part of high density in a multi-color toner image obtained by superimposing toner images of three colors, there may be cases where the thickness (level) of the toner layer of the high-density part in the multi-color toner image is three times or more greater than that of the toner layer of the low-density part in the monochromatic toner image. In view of the foregoing, in order to apply an adequate amount of the fixing fluid 9 in accordance with the amount of toner, it is particularly important that the elastic coating roller 32 is brought into a contact state under a predetermined press force. Moreover, being prepared as an aqueous solution having a low viscosity, the fixing fluid 9 finds its way smoothly into the region between the toner 8 particles, the region between the toner 8 particle and the intermediary transfer belt 22, and others, and at the same instant the toner 8 particles can be swollen and softened. In addition, since the intermediary transfer belt 22 is heated by the heating section 27 disposed inside the supporting roller 24, the fixing fluid 9 applied to the intermediary transfer belt 22 can be dried in a short time following the completion of the swelling and softening of the toner 8. As a result, it is possible to avoid that an excess of the fixing fluid 9 is adhered to the recording medium P that will eventually cause generation of wrinkles, curls, or the like.

Figure 4:
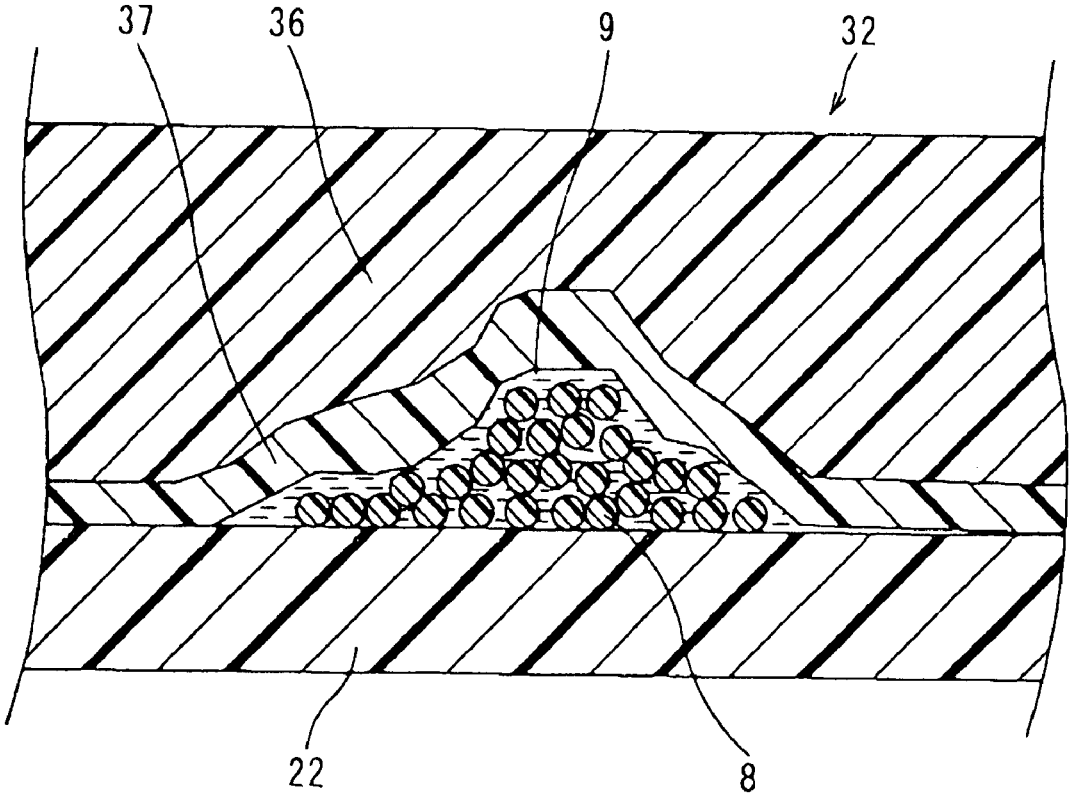
FIG. 4 is a sectional view schematically illustrating how the fixing fluid is applied to a toner image formed on the intermediary transfer belt by the coating roller.

FIG. 4 is a sectional view schematically illustrating how the fixing fluid 9 is applied to a toner image formed on the intermediary transfer belt 22 by the coating roller 32. At the instant when the coating roller 32 makes contact with the toner image (an image region) formed on the intermediary transfer belt 22, the permeation control layer 36 and the porous layer 37 of the coating roller 32 are elastically deformed to eventually cave in. The toner image, namely the aggregation of the toner 8, has many crevices and is thus large in surface area per unit area when viewed macroscopically. Therefore, at this time, a large amount of the fixing fluid 9 exudes through the porous layer 37 so as to be filled in the crevices around the toner 8 particles. In this way, the toner 8 particles can be swollen and softened. Herein "area viewed macroscopically" of "surface area per unit area when viewed macroscopically" means a section per unit area in which no thought is taken for asperities of the surface, and "surface area" of "surface area per unit area when viewed macroscopically" means a surface area in which asperities observed microscopically are taken into account. On the other hand, in the toner image-free smooth surface region of the intermediary transfer belt 22 (a non-image region), neither the permeation control layer 36 nor the porous layer 37 undergoes elastic deformation. Moreover, the non-image region is small in surface area per unit area when viewed macroscopically, wherefore a less amount of the fixing fluid 9 exudes thereto through the porous layer 37. That is, the fixing fluid 9 is applied selectively only to the image region. This makes it possible to avoid that, for example, the intermediary transfer belt 22 is contaminated with the fixing fluid 9, as well as to achieve a reduction in fixing fluid 9 consumption.

Moreover, that part of the toner image which has toner lamination, namely the part which is high in toner amount on a per-unit-area basis, is large in surface area per unit area correspondingly, and thus receives application of a larger amount of the fixing fluid 9. In this way, the amount of application of the fixing fluid 9 can be controlled in accordance with per-unit-area toner amount, wherefore the application amount of the fixing fluid 9 varies between the image region and the non-image region. The elastically deformable porous layer 37 retains the fixing fluid 9, and the surface of the coating roller 32 becomes deformed in conformity with the asperities of the toner image. This allows, even if the amount of toner varies from part to part in the toner image, the fixing fluid 9 to be applied properly to the low-level part thereof. That is, even a multi-color toner image in which the amount of adherent toner varies greatly from part to part can be fixed uniformly, wherefore a high-quality image can be produced. Moreover, as the permeation control layer 36 and the porous layer 37 undergo elastic deformation, the fixing fluid 9 is squeezed out of the pores. In a case where the toner is adhered to part of the smooth surface region of the intermediary transfer belt 22, that part of the porous layer 37 which makes contact with the adherent toner becomes deformed locally. This makes it possible to apply a larger amount of the fixing fluid 9 to the region onto which the toner is adhered, namely the toner image-present region Further, since the coating roller 32 and the toner image make contact with each other with the fixing fluid 9 lying therebetween, the direct contact between the toner image and the coating roller 32 is avoidable. This helps prevent the adhesion of the toner 8 to the coating roller 32.

Figure 5A:
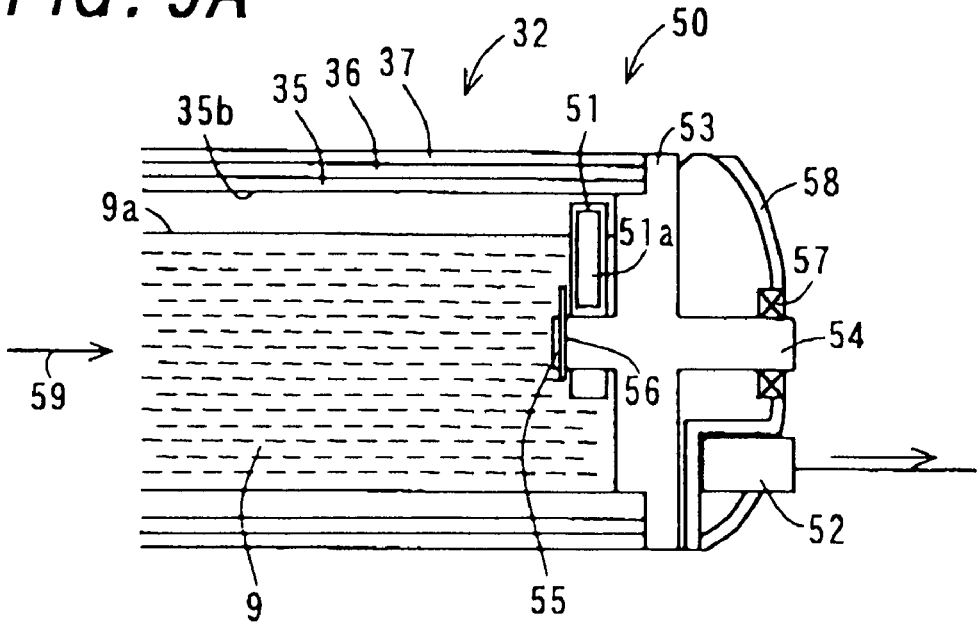

In reference to FIGS. 3 and 5A, the coating roller 32 has a coating roller gear 38 disposed at one axial end portion thereof, and also has a liquid level detecting section 50 disposed at the other axial end portion thereof. The coating roller gear 38 constitutes, together with an intermediary gear 44 and a driving gear 45, a driving section for rotating the coating roller 32 provided as an applying member. The coating roller gear 38 is disposed rotatably in engagement with the intermediary gear 44. The intermediary gear 44, which is disposed coaxially with the pivot 41, has its one side engaged with the coating roller gear 38, and the other side engaged with the driving gear 45. The driving gear 45 is engaged with the intermediary gear 44, and is rotated by a non-illustrated driving mechanism. When the driving gear 45 is rotated, the rotation is transmitted through the intermediary gear 44 to the coating roller gear 38, whereupon the coating roller 32 is driven rotatably. Note that the pivot 41 disposed coaxially with the intermediary gear 44 acts as a center of rotation of the fixing fluid chamber 31. Even if the fixing fluid chamber 31 is moved up-and-down or moved rotationally by the contact and release operation section 34, the center-to-center distance among the coating roller gear 38, the intermediary gear 44, and the driving gear 45 remains unchanged. Accordingly, the coating roller 32 can be rotated with stability regardless of whether it is kept in contact with or kept away from the intermediary transfer belt 22.

In this embodiment, the rotational circumferential velocity of the coating roller 32 is set to be lower than that of the intermediary transfer belt 22. Moreover, although not shown in the figure, a one-way clutch may be disposed in the coating roller gear 38. In this case, the coating roller 32 is, when kept in contact with the intermediary transfer belt 22, trailingly rotated at the same rotational circumferential velocity as that of the intermediary transfer belt 22. This helps prevent the occurrence of irregularity in the toner image on the intermediary transfer belt 22 resulting from the difference in rotational circumferential velocity between the coating roller 32 and the intermediary transfer belt 22.

Figure 5B:
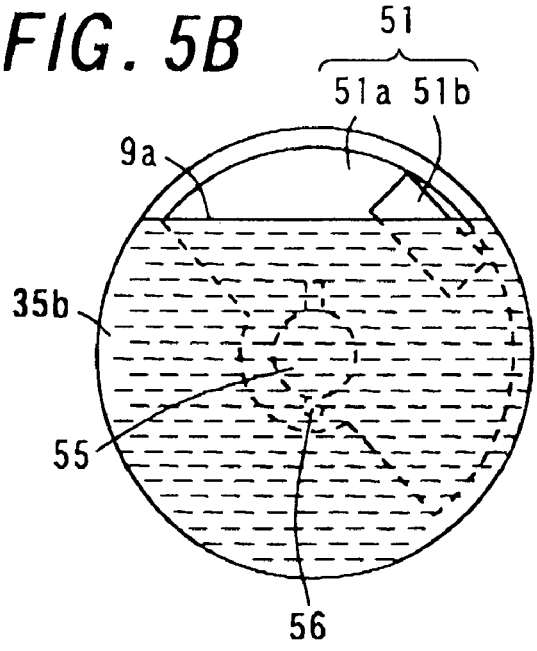
Figure 5C:
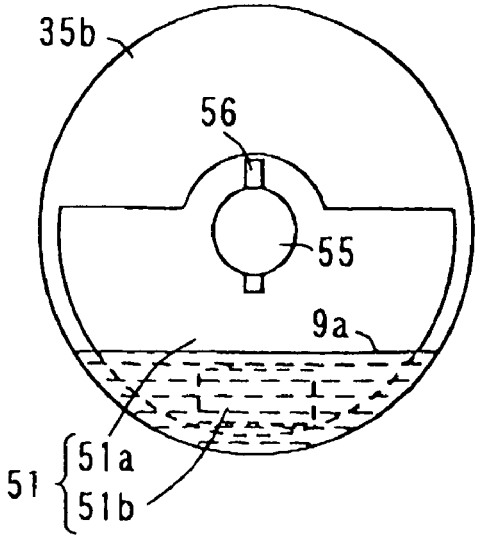

FIGS. 5A through 5C are views schematically illustrating the structure of the liquid level detecting section 50. FIG. 5A is a fragmentary longitudinal sectional view showing the coating roller 32, and FIGS. 5B and 5C are cross-sectional views showing the coating roller 32, looking in a direction indicated by arrow 59. The liquid level detecting section 50 is disposed at the other axial end portion of the coating roller 32, namely the end opposite to one axial end portion at which is disposed the coating roller gear 38. The liquid level detecting section 50 is composed of a float 51 acting as a second fixing-fluid level indicator member and a magnetic permeation sensor 52 acting as second position detecting section.

At the other axial end portion of the coating roller 32, the float 51 is rotatably fixed to a supporting shaft 55, with its axial position kept regulated, by a pin-shaped stopper member 56. The supporting shaft 55 is formed on a fixing fluid storage chamber (an interior of the metal core 35)-sided surface of a flange 53 (the surface of the flange 53 opposite to the surface on which is formed a rotary shaft 54, when viewed in the direction of thickness of the flange 53) integrally therewith and coaxially with the rotary shaft 54. The flange 53 is formed integrally with the rotary shaft 54 which is coaxial with the coating roller 32. That is, the float 51 is, in the fixing fluid storage chamber (the interior of the metal core 35), supported on an inner surface 35*b* of the metal core 35 in a non-contact manner so as to be rotatable about the supporting shaft 55. The float 51 is composed of a hollow member 51*a* which is substantially fan-shaped and a magnetic metal plate 51*b*. For example, the fan-shaped hollow member 51*a* is made of synthetic resin or the like material which is free from any damage ascribable to the fixing fluid 9. The hollow member 51*a* may be designed either to have an interior space which occupies the whole of its inside part or to have one or two or more interior spaces formed in the localized regions of its inside part. This hollow member 51*a* is rotated about the supporting shaft 55. The magnetic metal plate 51*b* is attached to a circumferential midportion of the fixing fluid storage chamber-facing surface of the hollow member 51*a*. For example, the magnetic metal plate 51*b* may be made of a magnetic stainless steel plate.

In accordance with the liquid level 9*a* of the fixing fluid 9 in the vertical direction, the float 51 is maintained in certain postures under a buoyant force exerted in the fixing fluid 9. As shown in FIG. 5B, in a case where the fixing fluid 9 is stored in the fixing fluid storage chamber (the interior of the metal core 35) in such an amount that its liquid level 9*a* is located above the supporting shaft 55 in the vertical direction, the float 51 floats in the fixing fluid 9 within the fixing fluid storage chamber under a buoyant force, and is maintained in such a posture that part of it is located above the liquid level 9*a*. Correspondingly, the magnetic metal plate 51*b* is located in the upper part of the interior of the fixing fluid storage chamber. On the other hand, as shown in FIG. 5C, in a case where the liquid level of the fixing fluid 9 is lowered to a predetermined level or therebelow as the result of consumption of the fixing fluid 9, the float 51 remains unrotated, and is maintained in such a posture that the magnetic metal plate 51*b* is arranged in closest proximity to the lowermost part of the fixing fluid storage chamber in the vertical direction. In this way, the position at which the float 51 with the magnetic metal plate 51*b* is held varies with the liquid level of the fixing fluid 9 within the fixing fluid storage chamber. Accordingly, by detecting, at a predetermined location, variation in magnetic force resulting from the change of position at which the magnetic metal plate 51*b* is held, it is possible to ascertain the remaining amount of the fixing fluid 9 within the fixing fluid storage chamber without fail.

The magnetic permeation sensor 52, which is arranged facing the float 51 with the flange 53 lying therebetween, is supported by a marginal enclosure 58 fitted to the flange 53. The marginal enclosure 58 is formed integrally with a bearing 57 of the rotary shaft 54. The magnetic permeation sensor 52 detects the intensity of magnetic force exerted by the magnetic metal plate 51*b*. Since the intensity of the magnetic force varies with the distance between the magnetic permeation sensor 52 and the magnetic metal plate 51*b*, the position of the magnetic metal plate 51*b* can be determined by detecting the magnetic force, and, on the basis of the position of the magnetic metal plate 51*b*, the liquid level of the fixing fluid 9 can be obtained by calculation with accuracy. The magnetic permeation sensor 52 is electrically connected to the control unit 130 for controlling all of the workings of the image forming apparatus 1. The control unit 130 is provided with the storage section, the calculation section, and the control section. The storage section receives in advance input of various data, for example the relationship between the magnetic force and the fixing fluid level that has been experimentally determined and such a level of the fixing fluid in the fixing fluid storage chamber as is necessary for effecting smooth image formation. The result detected by the magnetic permeation sensor 52 is inputted to the storage section of the control unit 130. In the calculation section, a comparison is made between the result detected by the magnetic permeation sensor 52 and the aforementioned data retrieved from the storage section to calculate the current fixing fluid amount. Moreover, it is determined whether the current fixing fluid amount is ideal for effecting smooth image formation or not. When the judgment result produced by the calculation section shows that the current fixing fluid amount is not ideal for effecting smooth image formation, then the control section sends a control signal to a non-illustrated operation panel disposed on the upper surface of the image forming apparatus 1 to display thereon a notice of necessity to replace the fixing fluid applying section 4 with the new one. This helps users to make the replacement of the fixing fluid applying section 4.

By virtue of the liquid level detecting section 50 thus constructed, the remaining amount of the fixing fluid 9 can be detected with accuracy. Considering that the fixing fluid 9 exhibits volatility, if the remaining amount of the fixing fluid 9 is calculated on the basis solely of the amount of the fixing fluid 9 applied to a toner image, the degree of fluid volatilization will not be taken into account, which leads to inaccurate determination of the remaining amount. In this regard, according to the liquid level detecting section 50, the change of position of the magnetic metal plate 51*b* fitted to the float 51 is detected as variation in magnetic force by the magnetic permeation sensor 52, and, on the basis of this detection result, the current amount of the fixing fluid within the fixing fluid storage chamber of the coating roller 32 is calculated. Thence, on an as needed basis, a notice is given to make users aware of the necessity of replacement of the fixing fluid applying section 4.

In reference to FIG. 3, the second seal member 33 is composed of a film-shaped member 39 and a supporting member 40. The film-shaped member 39 is formed spacedly on or preferably in intimate contact with the surface of the coating roller 32, except for that part thereof which exposedly projects through the opening 31*a* of the fixing fluid chamber 31 into the outside space (the entire surface of that part of the coating roller 32 which is included in the fixing fluid chamber 31). Moreover, the film-shaped member 39 is bonded to the supporting member 40 by means of thermal fusion welding or otherwise. Even if the film-shaped member 39 is brought into intimate contact with the surface of the coating roller 32, since the fixing fluid 9 slightly exudes to the surface of the coating roller 32 whereby to produce a lubrication effect, it follows that the coating roller 32 can be rotated without a hitch. The film-shaped member 39 is formed of a synthetic resin-made sheet which is not subjected to any damage or quality degradation ascribable to the fixing fluid 9. This embodiment employs a 50 μm-thick polyethylene terephthalate film. The supporting member 40 is disposed in contact with an opening 31*a*-sided end 31*c* of the fixing fluid chamber 31 and with part of the surface of the coating roller 32 in the vicinity of the end 31*c*. Preferably, the supporting member 40 is supported at the end 31*c* so as to dip with part of the surface of the coating roller 32 in the vicinity of the end 31*c*. Being designed to make pressure-contact lightly with the surface of the coating roller 32, the supporting member 40 will neither hinder the rotatable drive to the coating roller 32 nor cause any damage to the surface thereof. The supporting member 40 is made of a material which exhibits high rigidity and nevertheless lends itself to thermal fusion welding for the film-shaped member 39, for example, metal, synthetic resin, or the like material. In this embodiment, the supporting member 40 is made of a wire.

The second seal member 33 serves to stop up the gap between the fixing fluid chamber 31 and the coating roller 32 in the vicinity of the opening 31*a* of the fixing fluid chamber 31. This helps prevent, for example, the leakage of the fixing fluid 9 from the fixing fluid chamber 31 caused by a gravitational force, vibration, or other factors and the volatilization of the fixing fluid 9, and thus achieve a reduction in fixing fluid 9 consumption.

In reference to FIG. 3, the contact and release operation section 34 includes an eccentric cam 46, and in collaboration with the pivot 41 and the press spring 47, the eccentric cam 46 acts to rock the fixing fluid chamber 31 about the pivot 41 in such a manner that the coating roller 32 is moved to contact and release from the intermediary transfer belt 22. The eccentric cam 46 is so supported as to be driven to rotate freely about a rotary shaft 46*a* by a non-illustrated driving mechanism. The eccentric cam 46 is so disposed that its major axis portion abuts against part of the outer peripheral surface of the fixing fluid chamber 31 in the vicinity of one of the ends 31*c* located closer to the open/close gate 43 around the opening 31*a* of the fixing fluid chamber 31. As the eccentric cam 46 is rotated, so the fixing fluid chamber 31 is moved in the vertical direction thereby moving the coating roller 32 to contact and release from the intermediary transfer belt 22. In the state illustrated in FIG. 3, the minor axis portion of the eccentric cam 46 and the outer peripheral surface of the fixing fluid chamber 31 are separated by a certain gap from each other, and the coating roller 32 is kept in pressure-contact with the intermediary transfer belt 22. In this state, upon a half-rotating of the eccentric cam 46, then the major axis portion of the eccentric cam 46 abuts against the outer peripheral surface of the fixing fluid chamber 31 thereby pressing the fixing fluid chamber 31 to move downward in the vertical direction. Upon the press action of the eccentric cam 46, the fixing fluid chamber 31 is rotated about the pivot 41 thereby moving the coating roller 32 away from the intermediary transfer belt 22.

The rotatable drive to the eccentric cam 46 is controlled by the control unit 130 for controlling all of the workings of the image forming apparatus 1. The control unit 130 keeps track of the position of the coating roller 32 with respect to the intermediary transfer belt 22; that is, whether the coating roller 32 assumes a separation position or an abutment position. For example, the position of the coating roller 32 can be determined on the basis of the result detected by an optional position sensor such as an optical sensor, or determined on the basis of the last rotatory motion of the eccentric cam 46 in storage. In response to an input of image data for image formation, the control unit 130 determines the position of the coating roller 32 at the time of the input. When it is determined that the coating roller 32 assumes the separation position, then the control unit 130 sends a control signal to a non-illustrated driving mechanism for rotating the eccentric cam 46 to rotate the eccentric cam 46 in such a manner that the minor axis portion of the eccentric cam 46 is separated by a certain gap from the outer peripheral surface of the fixing fluid chamber 31. On the other hand, when it is determined that the coating roller 32 assumes the abutment position, then the control unit 130 exercises control so as to maintain the current posture of the eccentric cam 46. When there is a pause in the input of image data, the control unit 130 sends a control signal to the driving mechanism for driving the eccentric cam 46 to rotate the eccentric cam 46 in such a manner that the major axis portion of the eccentric cam 46 abuts against the outer peripheral surface of the fixing fluid chamber 31. The input of image data is made by way of an external apparatus such as a scanner or a computer electrically connected to the image forming apparatus 1. Alternatively, the image forming apparatus 1 may be designed to incorporate a fax-receiving function. In this case, image data can be inputted thereto by way of an external facsimile machine.

In a case where the coating roller 32 situated at the separation position away from the intermediary transfer belt 22 is moved to the abutment position in contact with the intermediary transfer belt 22, it is desirable to give the coating roller 32 at least a half-rotating, preferably at least one rotating, before it reaches the abutment position. When the rotation of the coating roller 32 comes to a stop at the separation position, due mainly to a gravitational force, the fixing fluid 9 tends to collect in the lower part of the surface of the coating roller 32 in the vertical direction, and correspondingly the amount of the fixing fluid 9 in the upper part thereof is decreased. That is, the amount of the fixing fluid 9 on the surface of the coating roller 32 becomes uneven. If the fixing fluid 9 is applied to a toner image by the coating roller 32 in such a state, there arises lack of uniformity in the application of the fixing fluid 9. This gives rise to unevenness in glossiness and density in the fixed image, and thus image degradation is inevitable. In an effort to overcome this problem, by giving the coating roller 32 at least a half-rotating before it abuts against the intermediary transfer belt 22, it is possible to make the distribution of the fixing fluid 9 uniform on the surface of the coating roller 32. Accordingly, lack of uniformity in the application of the fixing fluid 9 and ensuing unevenness in glossiness and density can be prevented, wherefore high-quality images can be produced with stability.

According to the fixing fluid applying section 4, only in the case of effecting image formation, the coating roller 32 is brought into abutment with the intermediary transfer belt 22 to apply the fixing fluid 9 to a toner image formed thereon in a contact manner. The toner image, now kept in a swollen/softened state by the application of the fixing fluid 9, is conveyed to the transferring and fixing section 5 as the intermediary transfer belt 22 is driven to rotate.

In reference to FIG. 1, the transfer ring and fixing section 5 is composed of the supporting roller 25 and a transferring and fixing roller 60. The transferring and fixing roller 60 is constructed of a roller-shaped member to act mainly as a pressurizing roller. The transferring and fixing roller 60 is brought into pressure-contact with the supporting roller 25, with the intermediary transfer belt 22 lying therebetween, and is driven to rotate freely about its axis. As the transferring and fixing roller 60, those used customarily in this field can be used. In this embodiment, the transferring and fixing roller 60 is constructed of a roller-shaped member which is 30 mm in outer diameter and comprises a metal core, a 3 mm-thick silicone rubber layer having a hardness of 50 degrees (according to JIS-A) formed as an elastic layer on the surface of the metal core, and a 20 μm-thick PFA layer formed as an outer layer on the surface of the silicone rubber layer. Moreover, in this embodiment, the transferring and fixing roller 60 is brought into pressure-contact with the supporting roller 25, with the intermediary transfer belt 22 lying therebetween, under a line pressure of 8 N/cm, and receives no application of voltage. Upon the toner image kept in a swollen/softened state being conveyed to a location where the supporting roller 25 and the transferring and fixing roller 60 make contact with each other under pressure (a transfer-fixation nip portion), in synchronism therewith, the recording medium P is fed from the recording medium supply section 6. The toner image formed on the intermediary transfer belt 22 is pressed against and transferred onto the surface of the recording medium P, and then fixed into place.

In a case where the intermediary transfer belt 22 has its surface coated with a fluorine resin layer, the level of adhesion between the intermediary transfer belt 22 and the toner 8 is low. Therefore, substantially the whole amount of the toner constituting the toner image is transferred onto the recording medium P. Moreover, in a case where the intermediary transfer belt 22 includes a rubber layer, the toner image bearing surface 22*a* becomes deformed in conformity with the asperities of the recording medium P, wherefore the toner image can be brought into contact even with the concavities of the recording medium P. This makes it possible to obtain a uniformly transferred/fixed image. Further, in a case where the recording medium P contains cellulose fibers, the toner image is, when pressed against the recording medium P, forced into the cellulose fibers, and simultaneously the toner 8 particles fuse with one another, thereby leveling off the surface of the toner image on the recording medium P. This makes it possible to obtain a high-quality color image having excellent coloration and high glossiness that may be laid to the subtractive process effect and the surface smoothness. Moreover, the intermediary transfer belt 22 is made of a material which is impervious to the fixing fluid 9, and the fixing fluid 9 is applied only to the toner image in a substantially selective manner. This makes it possible to prevent the fixing fluid 9 from finding its way into the recording medium P and thus avoid generation of wrinkles, curls, or the like in the recording medium P, as well as to achieve a reduction in fixing fluid 9 consumption. Further, in this construction, the coating roller 32 for applying the fixing fluid 9 makes no direct contact with the recording medium P. Accordingly, even if the recording medium P contains cellulose fibers, it never occurs that clogging is caused by the adhesion of paper powder such as the cellulose fibers to the surface of the coating roller 32. Since lack of uniformity in the application of the fixing fluid 9 resulting from clogging can be prevented, it follows that high-quality images can be produced with stability for a longer period of time. According to the transferring and fixing section 5, the toner image kept in a swollen/softened state is transferred and fixed onto the recording medium P under a press force.

In reference to FIG. 1, the recording medium supply section 6 is composed of a recording medium cassette 61 for stocking the recording media P, a pick-up roller 62 for directing the recording media P to a conveyance path one by one, and a pair of resist rollers 63 and 64 for feeding the recording medium P, in synchronism with the conveyance of the toner image formed on the intermediary transfer belt 22 to the transfer-fixation nip portion, to the nip portion. According to the recording medium supply section 6, the recording media P placed within the recording medium cassette 61 are directed to the conveyance path one by one by the pick-up roller 62, and are then fed to the transfer-fixation nip portion by the resist rollers 63 and 64.

In reference to FIG. 1, the ejection section 7 is composed of a conveyance belt 65, a driving roller 66, a tension roller 67, and a paper ejecting roller 68. The conveyance belt 65 is designed as an endless belt stretched across the driving roller 66 and the tension roller 67, for forming a loop-like conveyance path. The recording medium P bearing an image formed thereon by the transferring and fixing section 5 is conveyed toward the paper ejecting roller 68 by the conveyance belt 65. For example, the conveyance belt 65 may be constituted by forming a 10 μm-thick cover layer made of PTFE on at least a recording medium conveying surface of a 100 μm-thick polyimide film to which a conducting agent is added to impart electrical conductivity. The driving roller 66 is driven to rotate freely about its axis by a non-illustrated driving mechanism. For example, the driving roller 66 may be composed of a hollow roller made of a metal material such as aluminum. The tension roller 67 imparts a tension of predetermined level to the conveyance belt 65 to prevent it from sagging down. For example, the tension roller 67 may be composed of a metal-made shaft body and a cover layer formed on the surface of the metal-made shaft body, or may be composed solely of a metal-made shaft body. For example, stainless steel is used to form the metal-made shaft body, and fluorine rubber is used to form the cover layer. The paper ejecting roller 68 serves to drop the recording medium P conveyed by the conveyance belt 65 into a paper output tray 69 disposed on an outer side face of the image forming apparatus 1. The paper ejecting roller 68 is composed of a pair of rollers that are brought into pressure-contact with each other, each of which is so supported as to be driven to rotate freely about its axis. According to the ejection section 7, the recording medium P bearing an image fixed thereon by the transferring and fixing section 5 is ejected into the paper output tray 69 disposed externally of the image forming apparatus 1.

In reference to FIG. 1, the image forming apparatus 1 is provided with control unit 130. For example, the control unit 130 is disposed in the upper part of the interior space of the image forming apparatus 1, and is a processing circuit which is realized by using a microcomputer, a microprocessor, or the like device which is provided with a central processing unit (CPU) and which includes a control section, a calculation section, a storage section, etc. The storage section of the control unit 130 receives input of, for example, an image formation command to be issued via the non-illustrated operation panel disposed on the upper surface of the image forming apparatus 1, the results detected by non-illustrated sensors or the like arranged at predetermined locations within the image forming apparatus 1, and image data provided from an external apparatus. On the basis of various input data (such as an image formation command, the result of detection, and image data), necessary judgment is made in the calculation section, and, in response to the result of judgment produced by the calculation section, the control section sends control signals. In this way, all of the workings of the image forming apparatus 1 are under control. As the storage section, those used customarily in this field can be used, for example, a read-only memory (ROM), a random-access memory (RAM), and a hard disk drive (HDD). As the external apparatus, electrical/electronic apparatuses that allow formation or acquisition of image data and are electrically connectable to the image forming apparatus can be used, for example, a computer, a digital camera, a television set, a video recorder, a DVD recorder, and a facsimile machine. The control unit 130 includes, in addition to the processing circuit, a power source for supplying power not only to the control unit 130 but also to various devices disposed inside the image forming apparatus 1.

According to the image forming apparatus 1, a toner image is formed on the intermediary transfer belt 22, namely the toner image carrier, by the toner image forming section 2. Then, the fixing fluid 9 is applied to the toner image in a contact manner by the fixing fluid applying section 4, whereupon the toner image is swollen and softened. The toner image is then transferred and fixed onto the recording medium P by the transferring and fixing section 5. Lastly, the recording medium P bearing the image fixed thereon is ejected onto the paper output tray 69.

Figure 6:
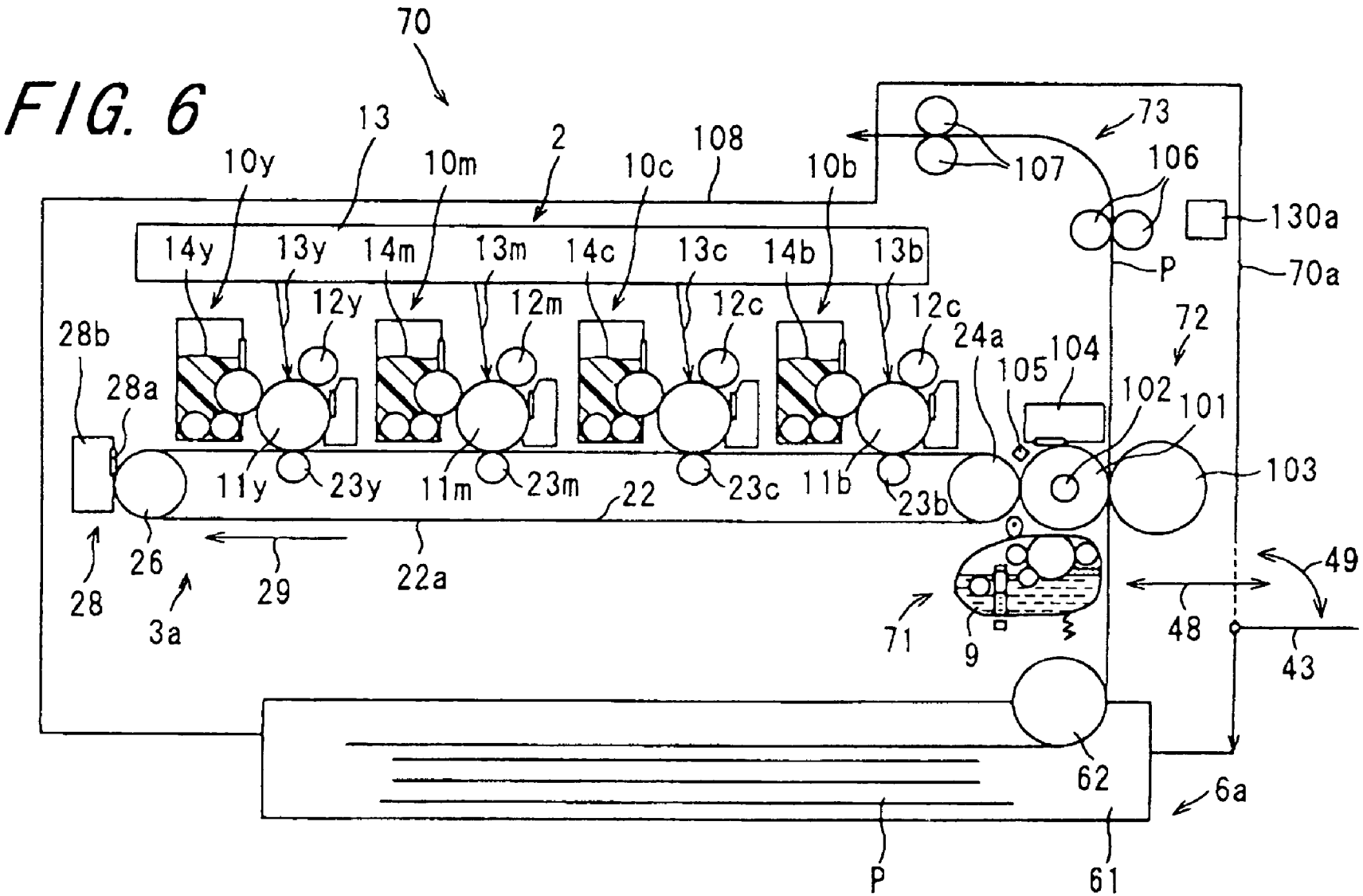
FIG. 6 is a sectional view schematically illustrating the constitution of an image forming apparatus according to a second embodiment or the invention.
Figure 7:
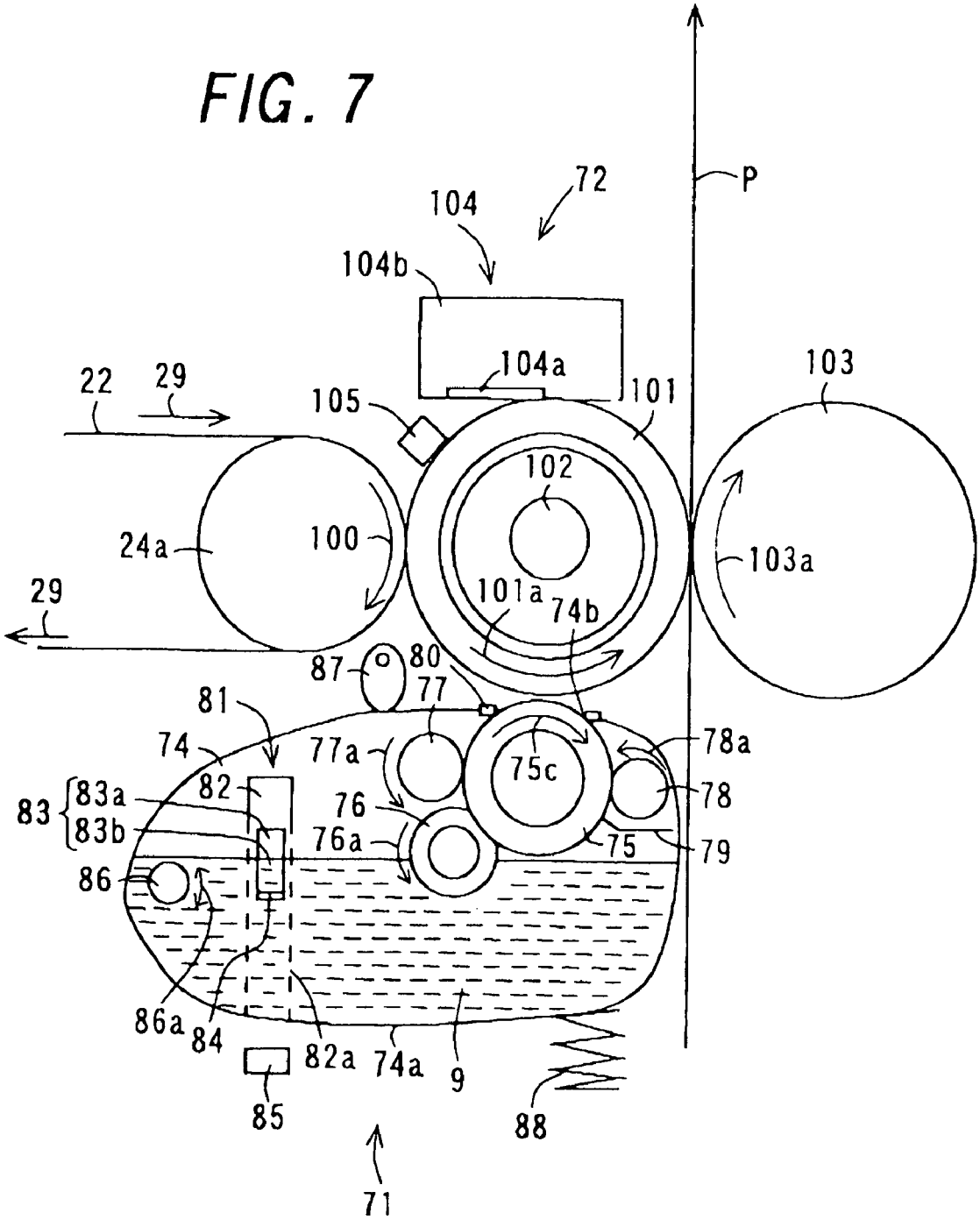
FIG. 7 is a sectional view schematically illustrating the structure of the main portion of the image forming apparatus depicted in FIG. 6.
Figure 8A:
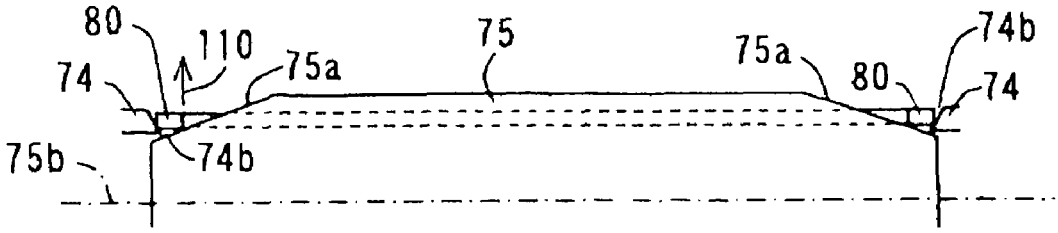
Figure 8B:
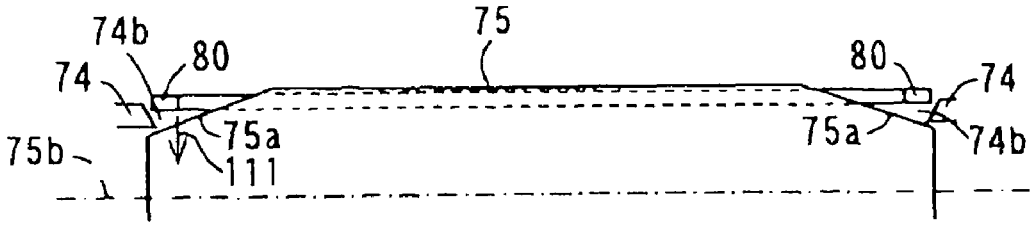
Figure 8C:
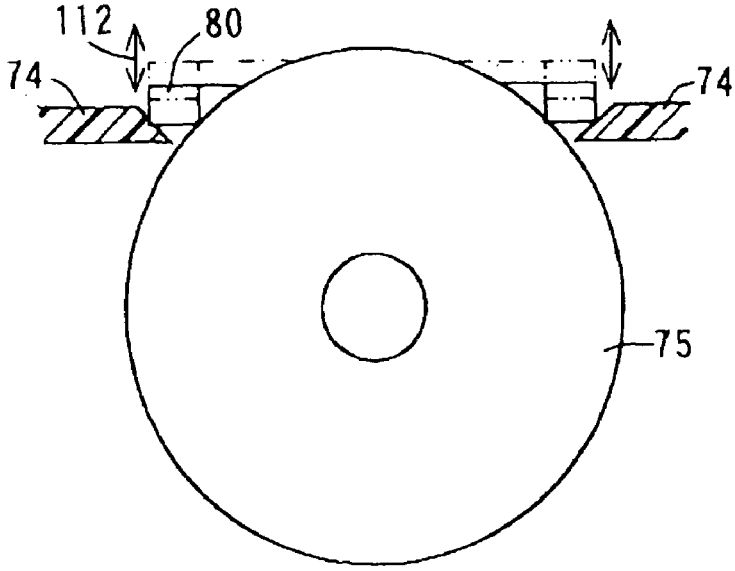
Figure 9:
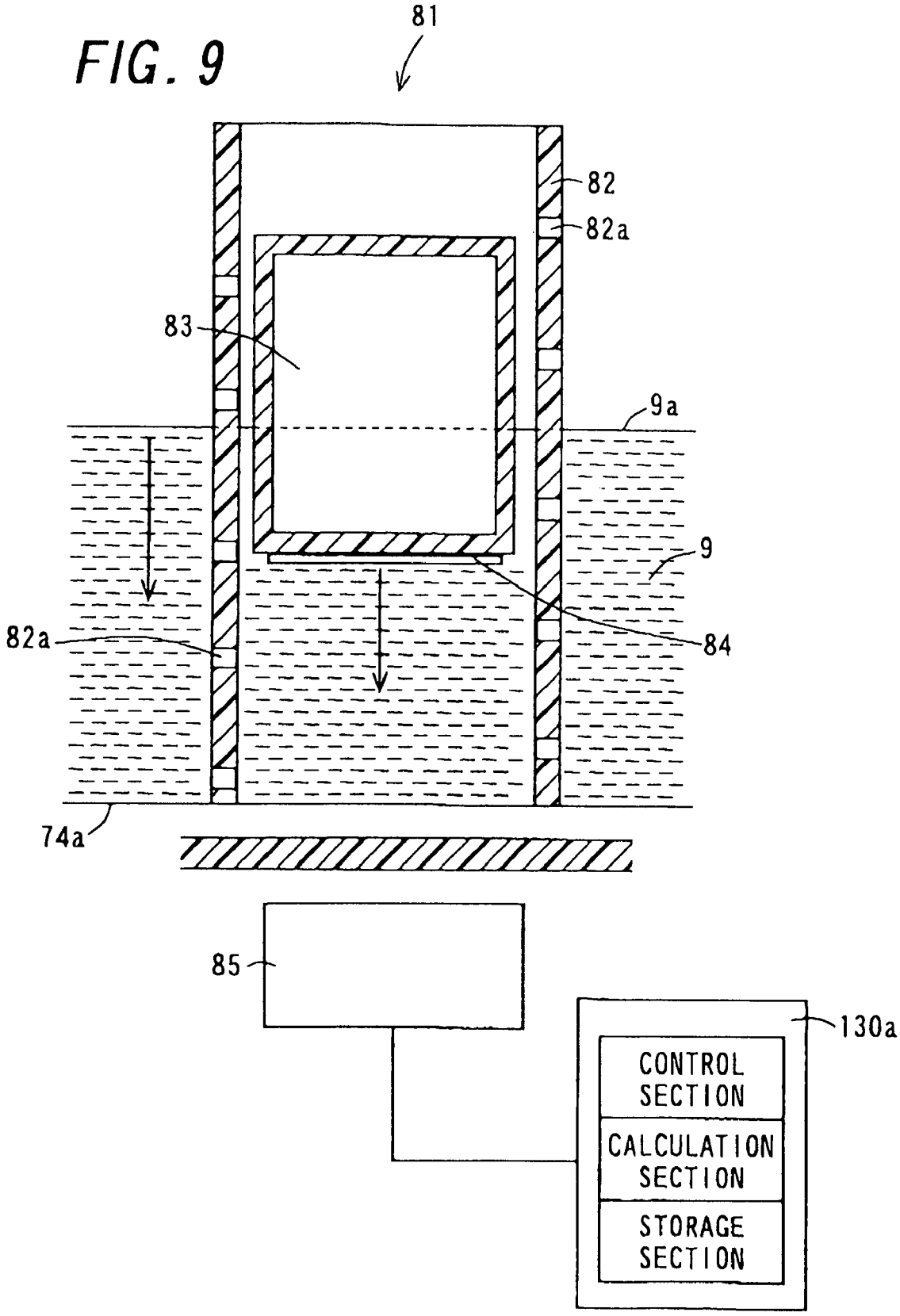
FIG. 9 is a sectional view schematically illustrating the structure of a liquid level detecting section.
Figure 10:
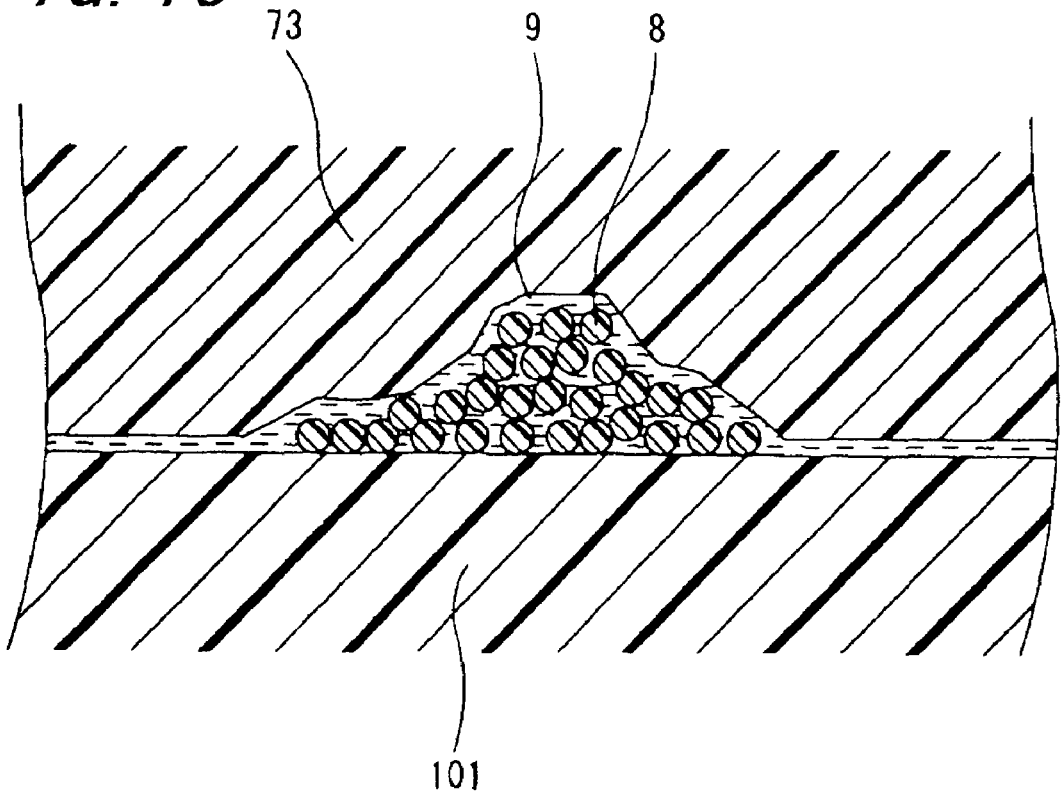
FIG. 10 is a sectional view schematically illustrating how the fixing fluid is applied to a toner image on a transferring and fixing roller by the coating roller.

FIG. 6 is a sectional view schematically illustrating the constitution of an image forming apparatus 70 according to a second embodiment of the invention. FIG. 7 is a sectional view schematically illustrating the structure of the main portion (a fixing fluid applying section 71 and a transferring and fixing section 72) of the image forming apparatus 70 depicted in FIG. 6. FIGS. 8A through 8C are views showing the behavior of a first seal member 80. FIGS. 8A and 8B are sectional views showing how a gap between a fixing fluid chamber 74 and a coating roller 75 is closed with the first seal member 80. FIG. 8C is a sectional view of the coating roller 75 illustrating the gap-closing operation using the first seal member 80 depicted in FIGS. 8A and 8B. FIG. 9 is a sectional view schematically illustrating the structure of a liquid level detecting section 81. FIG. 10 is a sectional view schematically illustrating how the fixing fluid 9 is applied to a toner image on a transferring and fixing roller 101 by the coating roller 75. The image forming apparatus 70 is analogous to the image forming apparatus 1, and therefore the constituent components that play the same or corresponding roles as in the image forming apparatus 1 will be identified with the same reference symbols, and overlapping descriptions will be omitted.

The image forming apparatus 70 differs from the image forming apparatus 1 in the following ways: an intermediary transfer section 3*a*, the fixing fluid applying section 71, the transferring and fixing section 72, a recording medium supply section 6*a*, and an ejection section 73. More specifically, the image forming apparatus 70 is not so designed that a toner image formed on the intermediary transfer belt 22 included in the intermediary transfer section 3*a* is transferred and fixed onto the recording medium P in a direct manner. That is, the transferring and fixing roller 101 acting also as a toner image bearing section is interposed between the intermediary transfer belt 22 and the recording medium P, and the fixing fluid applying section 71 applies the fixing fluid 9 to the toner image transferred from the intermediary transfer belt 22 to the transferring and fixing roller 101 under a heating condition. In this construction, no fixing fluid 9 is adhered to the intermediary transfer belt 22. Moreover, since the toner image is heated on the transferring and fixing roller 101, the intermediary transfer belt 22 is less prone to temperature rise. This helps prevent the toner 8 from undergoing quality degradation in the course of toner image formation due to the rise in temperature of the components constituting the toner image forming section 2, the adhesion of the fixing fluid 9 to the constituent components, and other factors. As a result, high-quality images can be produced with stability for a longer period of time. Further, the image forming apparatus 70 is characterized in that the fixing fluid applying section 71 is provided with the first seal member 80.

The intermediary transfer section 3*a* is composed of the intermediary transfer belt 22, intermediary transfer rollers 23*y*, 23*m*, 23*c*, and 23*b*, supporting rollers 24*a* and 26, and a belt cleaner 28. In the intermediary transfer section 3*a*, the supporting roller 24*a* is arranged downstream from the intermediary transfer roller 23*b* in the direction in which the intermediary transfer belt 22 is driven to rotate (a direction indicated by arrow 29). No heating section is disposed inside the supporting roller 24*a*. That is, in the intermediary transfer section 3*a*, neither the intermediary transfer belt 22 nor a toner image is subjected to application of heat, wherefore the provision of a temperature sensor is optional. In contrast to the intermediary transfer belt 22 of the image forming apparatus 1 that is supported at three points, the intermediary transfer belt 22 of the image forming apparatus 70 is supported at two points; that is, supported by the supporting rollers 24*a* and 26. Note that, in this embodiment, the intermediary transfer belt 22 is constituted by laminating a fluorine resin layer on a surface of a polyimide-made substrate.

In reference to FIGS. 6 and 7, fixing fluid applying section 71 is disposed vertically below the transferring and fixing section 72 so that the coating roller 75 moves to contact and release from the transferring and fixing roller 101. The fixing fluid applying section 71 is composed of the fixing fluid chamber 74, the coating roller 75, a supply roller 76, a regulatory roller 77, a cleaning roller 78, a partition wall 79, the first seal member 80, the liquid level detecting section 81, a pivot 86, an eccentric cam 87, and a press spring 88. Those constituent components, except for the pivot 86, the eccentric cam 87, the press spring 88, and in addition a magnetic permeation sensor 85 supported by the image forming apparatus 70, are unitized in the form of a cartridge which is freely attachable to and detachable from the image forming apparatus 70.

The fixing fluid chamber 74 is constructed of a vessel-shaped member having an interior space. In the fixing fluid chamber 74, when mounted in the image forming apparatus 70, a surface 74*a* constituting its bottom (a bottom face 74*a*) is substantially flat-shaped, whereas the other surfaces are made to have nonzero curvature. With such a surface configuration, even in a state of being separated from the image forming apparatus 70, the fixing fluid chamber 74 can be maintained in substantially the same posture as in the mounted state for a longer period of time. That is, it never occurs that during this time the fixing fluid 9 makes contact with the gap between the fixing fluid chamber 74 and the coating roller 75 that will eventually cause a leakage. In the fixing fluid chamber 74 are accommodated, in addition to the fixing fluid 9, the coating roller 75, the supply roller 76, the regulatory roller 77, and the cleaning roller 78. Moreover, the partition wall 79 is formed therein. The fixing fluid chamber 74 has an opening 74*b* formed on its transferring and fixing roller 101-facing surface in a direction longitudinally thereof. In the vicinity of a side face of the fixing fluid chamber 74 opposite to the side face thereof facing the open/close gate 43 is formed the pivot 86 so as to pass through the fixing fluid chamber 74. Moreover, although not shown in the figure, on the fixing fluid chamber 74-facing surface of the open/close gate 43 is formed a U-shaped guide groove so as to extend therefrom to the pivot 86. The pivot 86 is slidably inserted into the U-shaped guide groove. As the pivot 86 slides along the guide groove, the fixing fluid chamber 74 is moved in a direction indicated by arrow 48, thus allowing attachment and detachment of the fixing fluid chamber 74. When the pivot 86 is located at the front end of the guide groove, the coating roller 75 stands at a position to dip with the transferring and fixing roller 101 (working position). Moreover, in the vertical direction, on the bottom face of the fixing fluid chamber 74 is disposed the press spring 88 at a position near the open/close gate 43. By the action of the press spring 88, the fixing fluid chamber 74 is so supported as to be movable up-and-down in the vertical direction. The press spring 88 has its one end pressed against the fixing fluid chamber 74 to support it, and the other end supported by the main body of the image forming apparatus 70. As the press spring 88, for example, a coil spring, a leaf spring, and a torsion spring can be used. By the cooperative actions of the pivot 86 and the press spring 88, the coating roller 75 can be brought into contact with the transferring and fixing roller 101 under a press force of adequate level.

The coating roller 75 is constructed of a roller-shaped member, part of which protrudes vertically upwardly through the opening 74*b* of the fixing fluid chamber 74, and is thus allowed to move to contact and release from the surface of the transferring and fixing roller 101. Moreover, the coating roller 75 is rotatably supported by the fixing fluid chamber 74 in the direction of arrow 75*c*. The fixing fluid 9 is applied to the toner image on the transferring and fixing roller 101 by the coating roller 75. In this embodiment, the coating roller 75 is so arranged as to be kept clear of the fixing fluid 9 within the fixing fluid chamber 74.

For example, the coating roller 75 is constructed of a roller-shaped member composed of a metal core having formed on its surface an elastic layer. As shown in FIGS. 8A and 8B, the elastic layer of the coating roller 75 has a slant region 75*a* at both ends in its lengthwise direction. That is, in a direction perpendicular to the axis of the coating roller 75, the diameter of the cross section of the end portion is tapered from a position near the extremity of the end portion to the extremity. There is no particular limitation to the degree of the diametral taper of the end portion, and it can therefore be selected arbitrarily in consideration of, for example, the elasticity coefficient and mechanical strength of the material used to form the elastic layer. By forming the slant region 75*a* in the coating roller 75, even if, in the seal member 80, its inner edge contacted by the section of the opening 74*b* of the fixing fluid chamber 74 and by the slant region 75*a* of the coating roller 75 is substantially flat-shaped, it is possible to close the gap between the fixing fluid chamber 74 and the coating roller 75 with ease, and thus simplify the structure of the seal member 80. Moreover, at the time of applying the fixing fluid 9 by the coating roller 75 in a contact manner, the seal member 80 can be moved away from the coating roller 75 simply by moving the elastically deformed part thereof in the direction of the radius of the coating roller 75. This makes it possible to protect the coating roller 75 and the seal member 80 from abrasion caused by mutual contact, and thus simplify the structure of contact and release operation of the first seal member 80 with respect to the fixing fluid chamber 74 and the coating roller 75. Moreover, it never occurs that the coating roller 75 and the seal member 80 make contact slidingly with each other during the contact and separation operations.

The elastic layer is made of a material which has elasticity and exhibits wettability with respect to the fixing fluid 9.

Herein, an elasticity coefficient of the elastic layer in the direction of the radius thereof is taken as an index of elasticity. It is preferable that the elasticity coefficient of the elastic layer in the radial direction is smaller than that of the toner 8 or the toner material contained in the toner 8 such as the binder resin and the mold releasing agent. Specifically, the elasticity coefficient of the elastic layer should preferably be equal to or smaller than 1/10, and more preferably 1/100, of that of the toner 8 or the toner material. An index of wettability with respect to the fixing fluid 9 corresponds to a contact angle which the fixing fluid 9 makes with the material for use. The contact angle should preferably stand at or below 50 degrees. The examples of materials that satisfy such a requirement include: an elastic metal such as aluminum; a hydrophilic resin; and a rubber material such as ethylene propylene rubber and urethane rubber. This embodiment employs, as the coating roller 75, a 20 mm-diameter roller-shaped member composed of a 12 mm-diameter metal core having formed on its surface an elastic layer made of ethylenepropylene rubber having a Young's modulus of 2 MPa.

Moreover, in this embodiment, the coating roller 75 is, when brought into pressure-contact with the transferring and fixing roller 101, rotated at the same velocity as the surface velocity of the transferring and fixing roller 101. Since the material used to form the elastic layer of the coating roller 75 has a high affinity for the fixing fluid 9, the fixing fluid 9 can be retained in the form of a lamella on the surface of the coating roller 75. Therefore, a small amount of the lamellar fixing fluid 9 can be applied evenly over a wide area of the surface of the coating roller 75. This makes it possible to achieve a reduction in fixing fluid 9 consumption, as well as to avoid that an excess amount of the fixing fluid 9 is adhered to the surface of the coating roller 75 that will eventually sweep an unfixed toner image away, and thus prevent occurrence of image irregularity.

The coating roller 75 is elastically deformable under pressure because of having the elastic layer on its surface. As shown in FIG. 10, at a location where the coating roller 75 and the transferring and fixing roller 101 make contact with each other under pressure, that part of the surface of the coating roller 75 which makes pressure-contact with that part of the surface of the transferring and fixing roller 101 on which a toner image is present becomes elastically deformed in conformity with the asperities of the toner image to eventually cave in. During pressurization by the surface of the coating roller 75, the toner image receives higher pressure than does the toner image-free region on the surface of the transferring and fixing roller 101. That is, the pressure under which the toner image (the image region) makes contact with the lamellar fixing fluid 9 existing on the surface of the coating roller 75 is higher than the pressure under which the toner image-free region (the non-image region) makes contact therewith. Accordingly, even if the amount of toner varies from part to part in the toner image, the fixing fluid 9 can be applied evenly to the entire toner image irrespective of the presence of a high-level part having a large amount of the adherent toner 8 and a low-level part having a small amount of the adherent toner 8, and the amount of the fixing fluid 9 to be applied to the non-image region is small. It will thus be seen that the fixing fluid 9 can be applied evenly and selectively even to a multi-color toner image having appreciable asperities. Meanwhile, the toner image (the image region) is formed of the aggregation of the powdery toner 8, and is thus large in surface area per unit area when viewed macroscopically. In particular, a toner image which is thick with toner, just like a multi-color toner image obtained by superimposing toner images of a plurality of colors, is still larger in surface area per unit area when viewed macroscopically. On the other hand, the toner image-free region (the non-image region) on the transferring and fixing roller 101 has substantially a smooth surface, and is thus small in surface area per unit area when viewed macroscopically. Therefore, the amount of the fixing fluid 9 to be applied to the image region is far larger than that to be applied to the non-image region. In this way, the amount of application of the fixing fluid 9 can be controlled in accordance with per-unit-area toner amount, wherefore the application amount of the fixing fluid 9 varies between the image region and the non-image region. This makes it possible to apply the fixing fluid 9 only to the toner image, and thereby produce high-quality images that exhibit excellent fixability with respect to the recording medium P with stability for a longer period of time.

In the case of bringing the coating roller 75 into pressure-contact with the transferring and fixing roller 101, the press force (a line pressure) against the transferring and fixing roller 101 should preferably fall in a range of from 0.05 N/cm to 1.0 N/cm. If the press force is less than 0.05 N/cm, the contact between the coating roller 75 and the transferring and fixing roller 101 becomes unstable, and thus the fixing fluid 9 cannot be applied evenly to the toner image. Furthermore, since the coating roller 75 may fail to elastically deform sufficiently, there arises the possibility that the fixing fluid 9 cannot be applied sufficiently to the concavities of the toner image. This leads to lack of uniformity in the application of the fixing fluid 9 and thus to unevenness in glossiness, density, and coloration in the fixed image. By contrast, if the press force is greater than 1.0 N/cm, at the location where the coating roller 75 and the transferring and fixing roller 101 make contact with each other under pressure (a nip portion), the fixing fluid 9 on the surface of the coating roller 75 is unable to pass through the nip portion, and is eventually squeezed into a meniscus at the entrance of the nip portion. An excess of the fixing fluid 9 flows back toward the upstream side in the direction in which the coating roller 75 is rotated. At this time, the fixing fluid 9 flows vigorously at the entrance of the nip portion, which results in the occurrence of irregularity in the toner image. In this embodiment, in the case of bringing the coating roller 75 into pressure-contact with the transferring and fixing roller 101, the press force against the transferring and fixing roller 101 is set at 0.5 N/cm. By adjusting the press force in the aforementioned range, it is possible for the surface of the coating roller 75 to elastically deform without fail upon contact with the asperities of the toner image. In this state, the coating roller 75 makes pressure-contact with the toner image, with the lamellar fixing fluid 9 lying therebetween. Accordingly, a sufficient amount of the fixing fluid 9 can be applied to the high-level part of the toner image having a large amount of the adherent toner, and the fixing fluid 9 can be applied also to the low-level part having a small amount of the adherent toner (concavities) surrounded by the high-level part. That is, the toner image can be fixed uniformly into place regardless of the difference in toner amount, wherefore a high-quality fixed image can be produced.

Note that, as will be explained later on, three rollers: the supply roller 76, the regulatory roller 77, and the cleaning roller 78 abut against the surface of the coating roller 75. Therefore, the amount of the fixing fluid 9 may vary from part to part on the surface of the coating roller 75. In this case, if the coating roller 75 is operated to apply the fixing fluid 9 while still stationary, the application amount of the fixing fluid 9 becomes uneven on the transferring and fixing roller 101, which may lead to, for example, unevenness in density and glossiness in the fixed image. In an effort to prevent this problem, it is desirable to rotate the coating roller 75 before establishing contact with the transferring and fixing roller 101. This makes uniform the content of the fixing fluid 9 on the surface of the coating roller 75. This rotation of the coating roller 75 is effected under the control of the control unit 130 for controlling all of the workings of the image forming apparatus 70. In this way, high-quality images free from lack of uniformity in density and glossiness can be produced.

In the case of applying the fixing fluid 9 to the toner image on the transferring and fixing roller 101 by using the coating roller 75 having such a structure as described above, it is possible to apply the fixing fluid 9 also to a fogged toner which is adhered to the non-image region, and thus fix the fogged toner into place, too. This helps prevent occurrence of a smear in user's hands, clothing, and so forth.

In reference to FIG. 7, the supply roller 76 constructed of a roller-shaped member is disposed in pressure-contact with the coating roller 75, at least part of which is dipped in the fixing fluid 9 within the fixing fluid chamber 74. Moreover, the supply roller 76 is driven to rotate freely in a direction indicated by arrow 76*a* by a non-illustrated driving mechanism. This embodiment employs, as the supply roller 76, a sponge roller constituted by forming a 5 mm-thick, open-celled urethane foam layer on a surface of a 10 mm-diameter metal core. The supply roller 76 is rotated in the direction of arrow 76*a* while being dipped in the fixing fluid 9 to hold the fixing fluid 9 on its surface. The fixing fluid 9 deposited on the surface of the supply roller 76 is applied to the surface of the coating roller 75 at a location where the coating roller 75 and the supply roller 76 make contact with each other under pressure. In this way, since the fixing fluid 9 is fed to the outer peripheral surface of the coating roller 75, there is no need for the fixing fluid 9 to be stored inside the coating roller 75, wherefore the coating roller 75 can be made compact. Moreover, by disposing the section for storing the fixing fluid externally of the coating roller 75, it is possible to store a great amount of the fixing fluid 9, and thereby reduce the number of replenishment of the fixing fluid 9. Further, although this embodiment is so designed that the fixing fluid 9 is supplied to the coating roller 75 via the supply roller 76, the invention is not limited thereto. For example, the coating roller 75 may be so arranged that at least part of it is constantly dipped in the fixing fluid 9. This eliminates the need to provide the supply roller, wherefore the construction can be simplified and thus the cost of manufacturing can be reduced.

The regulatory roller 77 constructed of a roller-shaped member makes pressure-contact with the coating roller 75 and is rotated in the direction of arrow 77*a* by a non-illustrated driving mechanism. The regulatory roller 77 is so arranged as to be kept clear of the fixing fluid 9 within the fixing fluid chamber 74. At a location where the coating roller 75 and the regulatory roller 77 make contact with each other under pressure, the amount of the fixing fluid 9 held on the surface of the coating roller 75 is adjusted or regulated properly by the regulatory roller 77 to create an even thin layer of the fixing fluid 9. This embodiment employs a stainless steel-made roller having an external diameter of 12 mm as the regulatory roller 77. By virtue of the regulatory roller 77, it is possible to avoid that an excess amount of the fixing fluid 9 is adhered to the surface of the coating roller 75, which builds up at the entrance of the pressure-contact nip portion between the coating roller 75 and the transferring and fixing roller 101 to eventually cause a meniscus. Accordingly, the fixing fluid 9 is inhibited from flowing in contact with the toner image, in consequence whereof there results no irregularity in the toner image. That is, an image of high quality and high resolution can be produced.

The cleaning roller 78 constructed of a roller-shaped member makes pressure-contact with the coating roller 75 and is rotated in the direction of arrow 78*a* by a non-illustrated driving mechanism. The cleaning roller 78 is integral with the fixing fluid chamber 74, the coating roller 75, and other components in the form of a cartridge which is freely attachable to and detachable from the image forming apparatus 70. It is preferable that the material of construction of the cleaning roller 78 is smaller in contact angle with water and lower in mold releasability than the material used for the coating roller 75 (at least for the surface thereof). In particular, the use of a metal material such as stainless steel and aluminum is desirable from the viewpoint of durability, workability, etc. In the case of using the cleaning roller 78 which is smaller in contact angle and lower in mold releasability than the coating roller 75, the toner 8 on the surface of the coating roller 75 is adhered preferentially to the cleaning roller 78. This helps prevent undesirable accumulation of the toner 8 on the surface of the coating roller 75 that will eventually cause insufficiency or lack of uniformity in the application amount of the fixing fluid 9. Since the partition wall 79 is interposed to achieve separation between the cleaning roller 78 and the fixing fluid 9 within the fixing fluid chamber 74, it never occurs that the toner on the surface of the cleaning roller 78 drops down and is scattered in the fixing fluid 9. This helps protect the fixing fluid 9 from contamination.

Moreover, as the fixing fluid 9 is dried, so the toner 8 adherent to the surface of the cleaning roller 78 is stuck thereto. Therefore, the coating roller 75 is free from redeposition of the toner 8 on the cleaning roller 78. Further, since the toner 8 portions can be stuck on top of one another on the cleaning roller 78, the surface of the coating roller 75 can be cleaned up with stability for a longer period of time. In addition, by keeping the cleaning roller 78 in abutment with the coating roller 75 under constant pressure, it is possible to enhance the effect of cleaning the coating roller 75 produced by the cleaning roller 78, as well as to provide the high cleaning effect with stability.

As has already been described, in this embodiment, the cleaning roller 78, the coating roller 75, and other components are unitized in the form of a cartridge. Accordingly, when the fixing fluid 9 becomes depleted, the cartridge can be replaced with the new one. In this case, there arises no positional deviation between the coating roller 75 and the cleaning roller 78, wherefore the pressure under which the cleaning roller 78 abuts against the coating roller 75 can be maintained constant. Lastly, even if the toner 8 is stuck to the surface of the cleaning roller 78, the cleaning roller 78 is replaceable with the new one in accompaniment with the replacement of the cartridge. It will thus be seen that the toner 8 portions are stuck to the surface of the cleaning roller 78 within certain limits, wherefore the cleaning effect of the cleaning roller 78 remains about the same.

In the fixing fluid chamber 74, the partition wall 79 constructed of a platy member is interposed between the cleaning roller 78 and the liquid level of the fixing fluid 9 within the fixing fluid chamber 74, with its one end in a transverse direction spaced from the coating roller 75 at a slight interval so as not to hinder the rotational driving to the coating roller 75. As has already been explained, the provision of the partition wall 79 helps protect the fixing fluid 9 from contamination of the toner 8 dropped from the cleaning roller 78.

As shown in FIGS. 8A through 8C, the first seal member 80, which is constructed of a frame-shaped member having an outer peripheral portion and an inner peripheral portion, is supported by the non-illustrated contact and release operation section so as to be movable in a direction perpendicular to the axis 75*b* of the coating roller 75, that is, in the vertical direction. In this way, the first seal member 80 is allowed to abut against the opening 74*b* of the fixing fluid chamber 74 and the coating roller 75. As the material of construction of the first seal member 80, those offering resistance to corrosion by the fixing fluid 9 can be used. In particular, the use of a rubber material having adequate elasticity and mechanical strength such as silicone rubber is desirable. The first seal member 80 is moved to and fro between an abutment position and a separation position in a direction indicated by arrow 112, namely in the direction perpendicular to the axis 75*b* of the coating roller 75 that is, in the vertical direction. In this case, it never occurs that, upon contact with or separation from the fixing fluid chamber 74 and the coating roller 75, the first seal member 80 rubs against these components This helps prevent occurrence of problems such as an undesirable increase of rotary torque in the coating roller 75 and abrasion of the first seal member 80 in itself.

FIG. 8A shows the abutment position to be assumed by the first seal member 80. In FIG. 8C, the abutment position is indicated by a solid line. When sitting at the abutment position, the first seal member 80 is kept in abutment with the opening 74*b* and the coating roller 75 to close the gap between the fixing fluid chamber 74 and the coating roller 75 thereby sealing the fixing fluid chamber 74 hermetically. The bottom face of the first seal member 80 in the vertical direction is flat-shaped, and this bottom face abuts against the fixing fluid chamber 74 and the coating roller 75. The opening 74*b*-sided edge of the fixing fluid chamber 74 is tapered externally, and this tapered surface abuts against the first seal member 80. The slant region 75*a* formed at the axial end portion of the coating roller 75 is also an externally-tapered surface, and this tapered surface abuts against the first seal member 80, too. Note that the opening 74*b*-sided edge and the slant region 75*a* are tapered externally in the opposite directions. That is, the outer peripheral edge on the bottom face of the first seal member 80 abuts against the tapered surface of the opening 74*b*-sided edge, whereas the inner peripheral edge on the bottom face of the first seal member 80 abuts against the slant region 75*a* of the coating roller 75, whereupon the first seal member 80 undergoes elastic deformation to eventually make intimate contact with the fixing fluid chamber 74 and the coating roller 75. As a result, the gap between the fixing fluid chamber 74 and the coating roller 75 can be closed entirely circumferentially. The first seal member 80 is designed to assume the abutment position when the cartridge-type unit, to which it belongs together with the fixing fluid chamber 74, the coating roller 75, etc., is attached to and detached from the image forming apparatus 70. Alternatively, the first seal member 80 may be designed to assume the abutment position also during the time the cartridge-type unit is mounted in the image forming apparatus 70 so long as the apparatus is placed, for example, in a standby state where no image formation is carried out or a power-off state. The first seal member 80 can be shifted from the abutment position to the separation position by being moved in a direction indicated by arrow 110 by the non-illustrated contact and release operation section. At this time, since the coating roller 75 has the slant region 75*a*, all that needs to be considered is the elastically deformed part of the first seal member 80. Accordingly, the distance of movement is so short that the necessity for the cartridge-type unit to have a large size can be obviated.

FIG. 8B shows the separation position to be assumed by the first seal member 80. In FIG. 8C, the separation position is indicated by a dashed-two dotted line. When the first seal member 80 is sitting at the separation position, its bottom face is separated by a certain gap from each of the tapered surface of the opening 74*b*-sided edge of the fixing fluid chamber 74 and the slant region 75*a* of the coating roller 75. The first seal member 80 is designed to assume the separation position during the time the cartridge-type unit is mounted in the image forming apparatus 70. To be mentioned specially is that, being kept away from the coating roller 75 during its operation, the first seal member 80 never scrapes off a layer of the fixing fluid 9 on the coating roller 75, wherefore there arises no lack of uniformity in the application of the fixing fluid 9. The first seal member 80 can be shifted from the separation position to the abutment position by being moved in a direction indicated by arrow 111 by the non-illustrated contact and release operation section.

As has already been described, the first seal member 80, the fixing fluid chamber 74, the coating roller 75, and other components are unitized in the form of a cartridge. Accordingly, when the cartridge-type unit is attached to and detached from the main body of the image forming apparatus 70, it is possible to keep closing the gap between the fixing fluid chamber 74 and the coating roller 75 with the first seal member 80, and thus prevent leakage of the fixing fluid 9. Moreover, the replenishment of the fixing fluid 9 and the replacement of the constituent components such as the coating roller 75 and the first seal member 80 can be achieved at one time, without causing leakage of the fixing fluid 9, simply by replacing the cartridge-type unit with the new one. This enables long-term stable application of the fixing fluid 9. In order for the first seal member 80 to abut against the opening 74*b* of the fixing fluid chamber 74 and the coating roller 75 highly accurately with stability, it is important to maintain the positional relationship among the constituent components constant. In this regard, it is preferable that the first seal member 80 is included in the cartridge-type unit. The positional relationship among the constituent components can be maintained constant readily in the case of unitizing them in the form of a cartridge in the interest of replacement simplicity. According to the first seal member 80, the gap between the fixing fluid chamber 74 and the coating roller 75 can be closed thereby sealing the fixing fluid chamber 74 hermetically. This helps prevent leakage of the fixing fluid 9 especially when the cartridge-type unit, to which the first seal member 80 belongs together with the fixing fluid chamber 74, the coating roller 75, etc., is attached to and detached from the image forming apparatus 70.

Figure 12A:
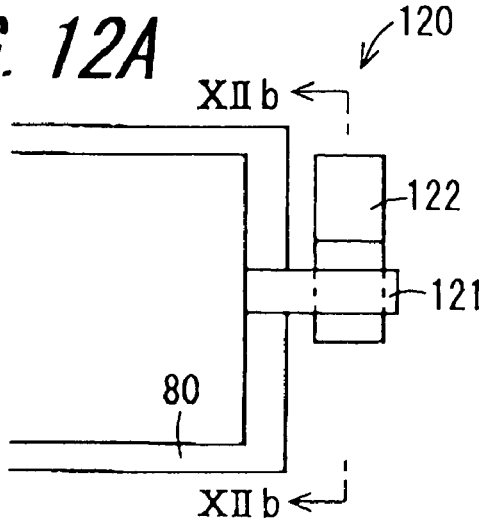
Figure 12B:
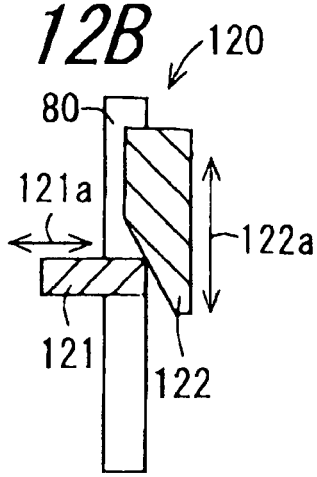

Shown in FIGS. 12A and 12B is a contact and release operation section 120 that exemplifies the contact and release operation section provided for the first seal member 80. FIGS. 12A and 12B are views schematically illustrating the structure of the contact and release operation section 120. FIG. 12A is a top view thereof and FIG. 12B is a sectional view thereof taken along the line XIIb-XIIb of FIG. 12A. The contact and release operation section 120 is composed of a slide member 121 and a wedge member 122. The slide member 121, which is formed integrally with each of the axial end portions of the first seal member 80, is movable reciprocally in a direction indicated by arrow 121*a* (that is; movable up-and-down in the vertical direction) by a non-illustrated spring member. The spring member has its one end connected to the vertex of a slide member 121 in the vertical direction, and the other end supported by a non-illustrated supporting member disposed in the main body of the image forming apparatus 70 or at the axial end portions of the fixing fluid chamber 74. The slide member 121 may be made of metal, synthetic resin, or the like material. Responsive to up-and-down movement of the slide member 121 in the vertical direction, the contact and separation between the first seal member 80 and the opening 74*b* of the fixing fluid chamber 74 as well as the coating roller 75 are repeated in an alternating manner. The wedge member 122 is disposed in parallel with the shorter side of the first seal member 80. The bottom face of the wedge member 122 in the vertical direction is square-shaped, whereas the top surface is tapered from the center line or its environs in a transverse direction of the wedge member 122 to the extremity in a direction toward the slide member 121. This tapered surface and the bottom face of the slide member 121 in the vertical direction are arranged in abutment with each other. The wedge member 122 is supported by a non-illustrated driving mechanism so as to move rectilinearly reciprocally in a direction indicated by arrow 122*a* (that is; in a direction parallel with the shorter side of the first seal member 80). The wedge member 122 may be made of metal, synthetic resin, or the like material. Responsive to movement of the wedge member 122 in the direction of arrow 122*a*, the abutment position between its tapered surface and the bottom face of the slide member 121 is shifted (or the height of the tapered surface relative to the bottom face at the abutment position in the vertical direction is changed), whereupon the slide member 121 is moved in the direction of arrow 121*a* to effect the contact and separation between the first seal member 80 and the opening 74*b* of the fixing fluid chamber 74 as well as the coating roller 75. For example, the wedge member 122 is moved in the direction of arrow 122*a* under the control of a control unit 130*a* for controlling all of the workings of the image forming apparatus 70. The control unit 130*a*, just like the control unit 130 in the image forming apparatus 1, is a processing circuit which is realized by using a microcomputer, a microprocessor, or the like device provided with the CPU and including a control section, a calculation section, a storage section, etc. The storage section receives in advance input of data about the conditions under which the first seal member 80 assumes the abutment and separation positions respectively. Specifically, the first seal member 80 assumes the abutment position when the cartridge-type unit to which it belongs together with the fixing fluid chamber 74, the coating roller 75, etc., is attached to and detached from the image forming apparatus 70, and during the time the apparatus is placed, for example, in a standby state where no image formation is carried out or a power-off state. On the other hand, the first seal member 80 assumes the separation position at all other times. On the basis of the data retrieved from the storage section, the calculation section decides which position for the first seal member 80 to assume as of this point of time. The result of judgment is sent to the control section. In accordance therewith, the control section sends a control signal to the driving mechanism for driving the wedge member 122 to move the wedge member 122 properly. Moreover, the wedge member 122 may be fixed at such a position within the image forming apparatus 70 as to push up the first seal member 80 to the separation position when the cartridge-type unit to which the first seal member 80 belongs together with the fixing fluid chamber 74, the coating roller 75, etc., is attached to the image forming apparatus 70. In this case, it is possible to ensure that the first seal member 80 is sitting at the separation position during the time the cartridge-type unit is mounted, and that the first seal member 80 is sitting at the abutment position before the attachment and after the detachment of the cartridge-type unit.

In reference to FIG. 9, the liquid level detecting section 81 is composed of a hollow position control member 82, a float 83 acting as a first fixing-fluid level indicator member, and a magnetic metal plate 84 and the magnetic permeation sensor 85 constituting first position detecting section.

The hollow position control member 82 is constructed of a pipe-shaped member having formed on its side wall a plurality of through holes 82*a* that permit inflow and outflow of the fixing fluid 9. The hollow position control member 82 is so designed that its one end protrudes from the liquid level 9*a* of the fixing fluid 9 within the fixing fluid chamber 74 into the interior space of the fixing fluid chamber 74, and the other end is supported on the fixing fluid chamber 74 while being dipped in the fixing fluid 9. By the through holes 82*a* formed on the side wall of the hollow position control member 82, the fixing fluid 9 within the hollow position control member 82 is maintained at a liquid level equal to the liquid level 9*a* of the fixing fluid 9 within the fixing fluid chamber 74. The hollow position control member 82 regulates horizontal movement of the float 83 to ensure that the float 83 moves up-and-down only in the vertical direction. In this way, the positional relationship between the float 83 and the magnetic permeation sensor 85 can be maintained constant, whereby making it possible to ascertain the remaining amount of the fixing fluid 9 within the fixing fluid chamber 74 without fail.

The float 83 constructed of a cylindrical-shaped member is placed in the interior space of the hollow position control member 82. The float 83 itself has a closed interior space, and floats in the fixing fluid 9 within the hollow position control member 82. The float 83 moves to change its vertical position depending upon increase and decrease of the fixing fluid 9. Synthetic resin that offers resistance to corrosion by the fixing fluid 9 is used to form the float 83.

The magnetic metal plate 84 is attached to the bottom face of the float 83 in the vertical direction. Responsive to up-and-down movement of the float 83, the magnetic metal plate 84 moves up-and-down. The magnetic metal plate 84, just like the magnetic metal plate 51*b*, may be made of a magnetic stainless steel plate.

The magnetic permeation sensor 85 is supported by the main body of the image forming apparatus 70, and is arranged facing the float 83 and thus the magnetic metal plate 84, with the bottom face 74*a* of the fixing fluid chamber 74 lying therebetween. The magnetic permeation sensor 85 detects the intensity of magnetic force exerted by the magnetic metal plate 84. Since the intensity of the magnetic force varies with the distance between the magnetic permeation sensor 85 and the magnetic metal plate 84, the position of the magnetic metal plate 84 can be determined by detecting the intensity of the magnetic force, and, on the basis of the position of the magnetic metal plate 84, the liquid level of the fixing fluid 9 can be determined. This makes it possible to ascertain the remaining amount of the fixing fluid 9 with accuracy. The remaining amount of the fixing fluid 9 is determined by using the magnetic permeation sensor 85 in the same manner as the case of using the magnetic permeation sensor 52.

The liquid level detecting section 81 may be integral with the fixing fluid chamber 74 and the constituent components housed therein in the form of a cartridge. In this case, there arises no positional deviation especially between the float 83 and the magnetic permeation sensor 85, wherefore the remaining amount of the fixing fluid 9 can be ascertained with accuracy at all times. By virtue of the liquid level detecting section 81, not only the amount of the fixing fluid 9 that has been applied to a toner image, but also the amount of the fixing fluid 9 that has been volatilized can be checked; that is, the exact amount of fixing-fluid 9 consumption can be ascertained. This makes it possible to make sure exactly when the cartridge-type unit of the fixing fluid chamber 74 and the constituent components housed therein has to be replaced. Moreover, since the operation mechanism is simply a matter of detecting the magnetic force exerted by the magnetic metal plate 84 attached to the bottom face of the float 83, the provision of the liquid level detecting section 81 requires little extra manufacturing cost.

In reference to FIG. 7, the eccentric cam 87 is operated in exactly the same manner as the eccentric cam 46 of the image forming apparatus 1. In collaboration with the pivot 86 and the press spring 88, the eccentric cam 87 rocks the fixing fluid chamber 74 about the pivot 86 in the direction of arrow 86*a* so that the coating roller 75 moves to contact and release from the transferring and fixing roller 100. Moreover, the rotatable drive to the eccentric cam 87 is controlled in the same manner as the eccentric cam 46.

According to the fixing fluid applying section 71, when image formation is effected, the coating roller 75 is brought into pressure-contact with the surface of the transferring and fixing roller 101 to apply the fixing fluid 9 to a toner image on the transferring and fixing roller 101 in a contact manner. On the other hand, when no image formation is effected, the coating roller 75 is moved away from the transferring and fixing roller 101. The fixing fluid chamber 74 of the fixing fluid applying section 71 and the constituent components housed therein are unitized in the form of a cartridge. When this cartridge-type unit is attached to or detached from the image forming apparatus 70, the gap between the fixing fluid chamber 74 and the coating roller 75 is closed with the first seal member 80, wherefore the fixing fluid 9 can be prevented from leaking from the fixing fluid chamber 74.

In reference to FIG. 7, the transferring and fixing section 72 is composed of the transferring and fixing roller 101, a pressurizing roller 103, a roller cleaner 104, and a temperature detecting section 105.

The transferring and fixing roller 101 constructed of a roller-shaped member is designed to be driven to rotate freely in a direction indicated by arrow 101*a* by a non-illustrated driving mechanism, one side of which is brought into pressure-contact with the supporting roller 24*a*, with the intermediary transfer belt 22 lying therebetween, and the other side of which is brought into pressure-contact with the pressurizing roller 103. In this embodiment, the transferring and fixing roller 101 is constructed of a roller-shaped member having an outer diameter of 30 mm composed of: a metal core made of a 1 mm-thick carbon steel; a 8 mm-thick silicone rubber layer formed on the surface of the metal core, the volumetric resistance of which falls in a range of from $10^8$ to $10^9$ Ω·cm; and a 20 μm-thick PFA layer formed on the surface of the silicone rubber layer. Moreover, in this embodiment, between the transferring and fixing roller 101 and the intermediary transfer belt 22 is impressed a transfer voltage of +1 kV at a potential reverse to the potential of the charged toner 8 constituting a toner image. In this way, the toner 8 is electrostatically attracted to the transferring and fixing roller 101, whereupon the toner image is transferred from the intermediary transfer belt 22 to the transferring and fixing roller 101. The transferring and fixing roller 101 is driven to rotate in the direction of arrow 101*a* while holding on its surface the toner image transferred from the intermediary transfer belt 22.

Inside the transferring and fixing roller 101 is disposed a heating section 102 which is constructed of a halogen lamp, for instance. By the heating section 102, the transferring and fixing roller 101 is heated at a uniform temperature throughout its circumferential surface. Moreover, the toner image borne on the surface of the transferring and fixing roller 101 is also heated to a temperature which is substantially the same as the temperature at which the transferring and fixing roller 101 is heated. In this embodiment, since the toner 8 for use contains such a binder resin as has a glass transition temperature of 90° C., it follows that the surface temperature of the transferring and fixing roller 101 is maintained at a temperature of 100° C. Upon the toner image being heated to a temperature which is equal to or higher than the glass transition temperature of the binder resin contained in the toner 8, then the binder resin is softened and thus the adherability between the toner 8 and the transferring and fixing roller 101 can be increased. This makes it possible to avoid that the toner 8 is offset with respect to the coating roller 75 and that the toner image is disturbed during the application of the fixing fluid 9. Accordingly, the fixing fluid 9 can be applied to the toner image, from its surface, by the coating roller 75 properly in a contact manner. Note that, when the fixing fluid 9 is applied, in a contact manner, to the toner image borne on the surface of the transferring and fixing roller 101 by the coating roller 75, the toner image and the transferring and fixing roller 101 undergo a drop in temperature. At this time, since the surface of the transferring and fixing roller 101 is heated to a temperature which is higher by 10° C. than the glass transition temperature of the binder resin contained in the toner 8, it is possible to make up for the decrease of temperature immediately, and thereby bring the toner 8 constituting the toner image into a swollen/softened state without a hitch. From the energy saving standpoint, it will be sufficient if the transferring and fixing roller 101 is heated to a temperature which is higher by approximately 10° C. than the glass transition temperature of the binder resin contained in the toner 8. By keeping the heating temperature at such a level, it is possible to minimize the loss of thermal energy resulting from heat dissipation. As another advantage, upon setting the apparatus in motion, a necessary temperature rise can be achieved at a lower energy expenditure and the temperature reaches a predetermined level in a short time, which results in a reduction in warm-up time. This eliminates the need to carry out a heat-retaining operation during standby, wherefore the apparatus as a whole serves the purpose of realizing energy conservation. The mechanism for controlling the surface temperature of the transferring and fixing roller 101 will be explained later on.

The toner image formed on the intermediary transfer belt 22 is electrostatically transferred onto the transferring and fixing roller 101 heated at a uniform temperature throughout its circumferential surface. Then, the toner image is heated at one surface upon contact with the surface of the transferring and fixing roller 101 in a heated state, and the fixing fluid 9 is applied peripherally to the other surface of the toner image opposite from the heated surface. Following the application of the fixing fluid 9, the toner image is swollen and softened in a heated state. As the transferring and fixing roller 101 is rotated, so the toner image is conveyed to a location where the transferring and fixing roller 101 and the pressurizing roller 103 make contact with each other under pressure (a transferring and fixing nip portion). In this way, the fixing fluid 9 is applied to the toner image on the transferring and fixing roller 101, which is provided as another toner image carrier independently of the intermediary transfer belt 22. Therefore, the intermediary transfer belt 22 is free of the adhesion of the fixing fluid 9. Moreover, aside from the intermediary transfer belt 22, heat is applied to the transferring and fixing roller 101. Therefore, the intermediary transfer belt 22 will not undergo temperature rise. This makes it possible to protect the toner from quality degradation in the course of toner image formation, and thereby produce high-quality images with stability for a longer period of time. Moreover, the toner image receives application of heat at one surface upon contact with the surface of the transferring and fixing roller 101, and receives application of the fixing fluid 9 at the other surface opposite from the heat-receiving surface in the direction of thickness of the toner image. That is, the toner image is subjected to toner swelling and/or softening treatment at both surfaces in the thickness wise direction. This enables stable production of images fixed onto the recording medium P with high fixation strength. If either of the heating operation and the fixing fluid 9 application is not carried out, images may be fixed onto the recording medium P unsatisfactorily.

The pressurizing roller 103 constructed of a roller-shaped member makes pressure-contact with the transferring and fixing roller 101 and is driven to rotate freely in a direction indicated by arrow 103*a* by a non-illustrated driving mechanism. This embodiment employs, as the pressurizing roller 103, a roller having an outer diameter of 40 mm composed of a metal core, a 2 mm-thick elastic layer made of silicone rubber having a hardness of 50 degrees (according to JIS-A) formed on the surface of the metal core, and a 20 μm-thick PFA-made outer layer formed on the surface of the elastic layer. In this embodiment, the pressurizing roller 104 is brought into contact with the transferring and fixing roller 101 under a press force of 10 N/cm (a line pressure).

The roller cleaner 104, which includes a cleaning blade 104*a* and a reservoir 104*b*, serves to remove the residual toner 8 and/or fixing fluid 9 remaining on the transferring and fixing roller 101 following the completion of the transference of the toner image on the transferring and fixing roller 101 onto the recording medium P. The cleaning blade 104*a* is brought into pressure-contact with the transferring and fixing roller 101 by a non-illustrated pressurizing section to scrape off the residual toner 8 and so forth remaining on the transferring and fixing roller 101. The reservoir 104*b* stores therein the toner 8 and/or the fixing fluid 9, and so forth that have been scraped off by the cleaning blade 104*a*.

In order to detect the surface temperature of the transferring and fixing roller 101, the temperature detecting section 105 is arranged upstream from the nip portion between the transferring and fixing roller 101 and the supporting roller 24*a* in the direction in which the transferring and fixing roller 101 is driven to rotate, namely in the direction of arrow 101*a*. The temperature detecting section 105 is arranged in contact with or in the proximity of the transferring and fixing roller 101. For example, a temperature sensor is used for the temperature detecting section 105. The result detected by the temperature detecting section 105 is inputted to the control unit 130 for controlling all of the workings of the image forming apparatus 70. In response to the input about the detection result, the control unit 130*a* sends a control signal to the heating section 102 to control application of heat to the transferring and fixing roller 101. In this way, the transferring and fixing roller 101 can be heated at a uniform temperature throughout its circumferential surface. In this embodiment, as has already been described, the surface temperature of the transferring and fixing roller 101 is maintained at 100° C.

According to the transferring and fixing section 72, the toner image formed on the intermediary transfer belt 22 is electrostatically transferred to the surface of the transferring and fixing roller 101 maintained at a predetermined temperature, and then the fixing fluid 9 is applied to the toner image in a contact manner by the fixing fluid applying section 71. After that, the toner image, now kept in a swollen/softened state, is fixed onto the recording medium P at the transfer-fixation nip portion. Following the completion of the transference of the toner image onto the recording medium P, the residual toner 8 and/or paper powder, and so forth remaining on the surface of the transferring and fixing roller 101 are removed by the roller cleaner 104, so that a next toner image can be transferred from the intermediary transfer belt 22 to the surface of the transferring and fixing roller 101.

In reference to FIG. 6, the recording medium supply section 6*a* is composed of a recording medium cassette 61 for stocking the recording media P and a pick-up roller 62 for directing the recording media P to a conveyance path one by one. According to the recording medium supply section 6*a*, the recording media P placed within the recording medium cassette 61 are directed one by one to the transfer-fixation nip portion by the pick-up roller 62.

In reference to FIG. 6, the ejection section 73 is composed of a conveyance roller 106 and a paper ejecting roller 107. According to the ejection section 73, the recording medium P bearing the toner image transferred and fixed thereon is conveyed toward the paper ejecting roller 107 by the conveyance roller 106, and is then ejected out of the image forming apparatus 70 by the paper ejecting roller 107. In this way, the recording media P are eventually piled upon a paper output tray 108 disposed on the upper surface of the image forming apparatus 70.

According to the image forming apparatus 70, a toner image is formed on the intermediary transfer belt 22 by the toner image forming section 2. The toner image is then transferred onto the transferring and fixing roller 101. The fixing fluid 9 is applied to the toner image in a contact manner by the fixing fluid applying section 71, whereupon the toner image is swollen and softened. The toner image is then transferred onto the recording medium P at the transfer-fixation nip portion. Lastly, the recording medium P bearing the toner image transferred thereon is ejected onto the paper output tray 108 by the ejection section 73.

Figure 11:
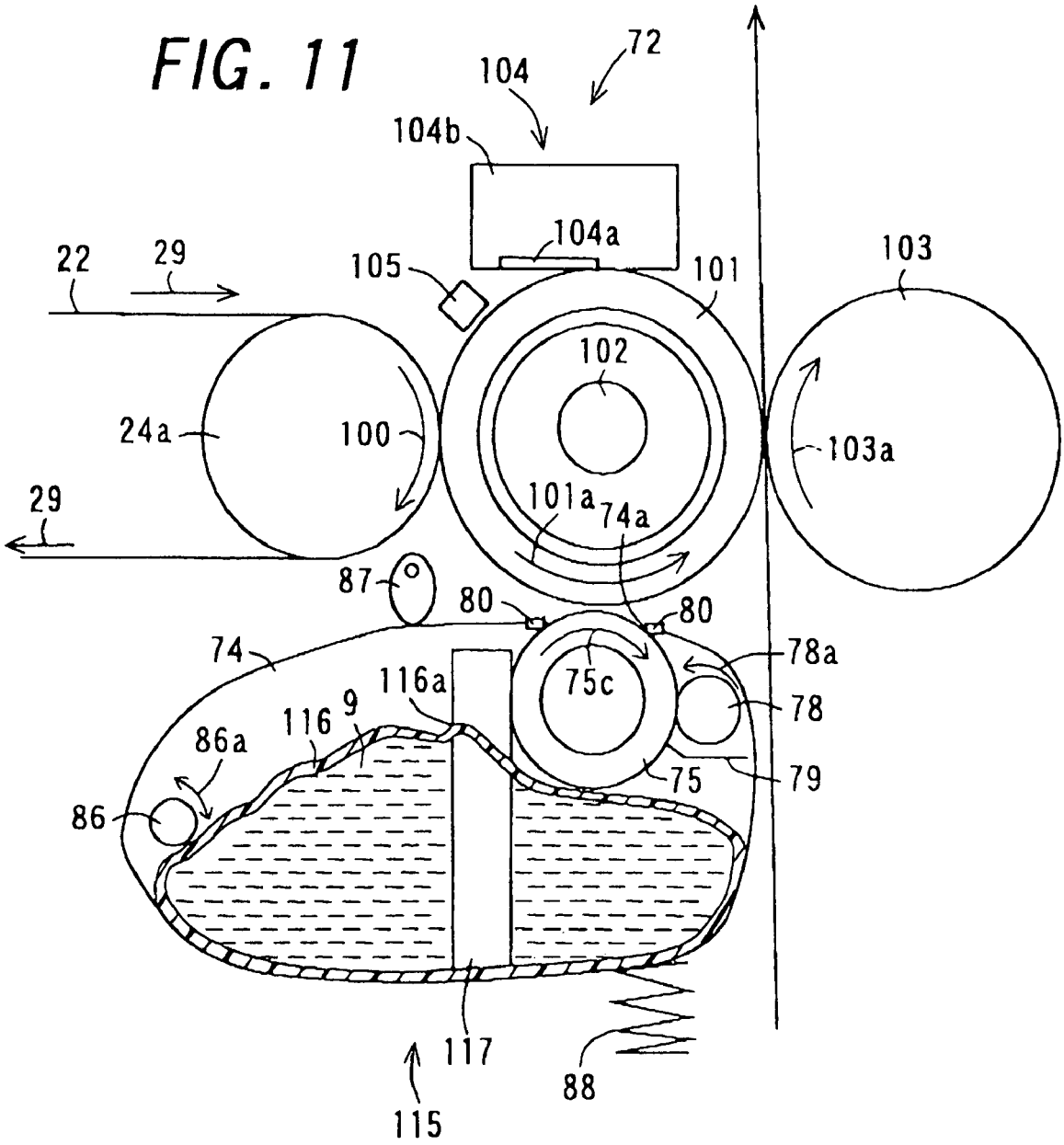
FIG. 11 is a sectional view schematically illustrating the structure of the fixing fluid applying section according to a modified embodiment.

While this embodiment employs the fixing fluid applying section 71, the invention is not limited thereto. For example, a fixing fluid applying section 115 shown in FIG. 11 may be employed instead. FIG. 11 is a sectional view schematically illustrating the structure of the fixing fluid applying section 115 according to a modified embodiment. The fixing fluid applying section 115 is analogous to the fixing fluid applying section 71, and therefore the constituent components that play the same or corresponding roles as in the fixing fluid applying section 71 will be identified with the same reference symbols, and overlapping descriptions will be omitted. The fixing fluid applying section 115 is characterized by having a fixing fluid container 116 and an application wick 117 placed inside the fixing fluid chamber 74.

The fixing fluid container 116 is constructed of a deformable case member formed of a flexible synthetic resin film or sheet. The fixing fluid container 116 has an opening 116*a*, and accommodates the fixing fluid 9 in its interior space. This embodiment employs a case formed of a 30 μm-thick polyethylene terephthalate film. The application wick 117 is constructed of a platy member made of, for example, a material which exhibits liquid permeability. In this embodiment, a felt is used therefor. The application wick 117 is so designed that at least part of one end is inserted through the opening 116*a* into the fixing fluid container 116 to dip with the fixing fluid 9, and at least part of the other end is kept in pressure-contact with the coating roller 75. The application wick 117 sucks up the fixing fluid 9 at one end contacted by the fixing fluid 9. The fixing fluid 9 thus sucked travels in the application wick 117 and is applied to the surface of the coating roller 75 through the other end contacted by the coating roller 75. The application wick 117 serves also as a regulatory roller to apply the fixing fluid 9 evenly over the surface of the coating roller 75. Note that, in order to avoid fluid leakage more reliably, a bonding treatment may be provided in the contact region between the opening 116*a* of the fixing fluid container 116 and the application wick 117. Moreover, in this embodiment, the fixing fluid container 116 and the application wick 117 are included in the cartridge-type unit of the fixing fluid chamber 74, the coating roller 75, etc. Accordingly, at the time when the cartridge-type unit is replaced with the new one because of the depletion of the fixing fluid 9 within the fixing fluid container 116, the replenishment of the fixing fluid 9 and the replacement of the constituent components such as the coating roller 75 can be achieved simultaneously. As another advantage, in this embodiment, the leakproof fixing fluid container 116 is hermetically set into the fixing fluid chamber 74. Accordingly, even if the cartridge-type unit including the fixing fluid chamber 74 is in storage for a long time while being maintained in a posture different from the posture it takes when mounted in the image forming apparatus 70, no leakage of the fixing fluid will occur.

While in the image forming apparatus according to the above-mentioned embodiments of the invention employs an admixture of water and one kind or two or more kinds of organic solvents as the fixing fluid 9 for swelling and softening toner, the fixing fluid 9 for use is not limited thereto. It is possible to use any conventionally-known fixing fluid suited for toner, or a fixing fluid containing a known bonding or adhesive ingredient. Specific examples of the bonding ingredient include: a rubber-base adhesive predominantly composed of polymeric elastomer such as chloroprene rubber, nitrile rubber, and SBR rubber; and an emulsion adhesive prepared by dispersing, in water, hydrophilic synthetic resin such as vinyl acetate, ethylene-vinyl acetate copolymer (EVA), and acrylic resin. In this case, not only the toner swelling/softening effect, but also an adhesive power exerted by the bonding or adhesive ingredient contributes to the adherability between the toner and the recording medium P. This makes it possible to attain enhanced adherability and thereby fix a toner image onto the recording medium P with higher fixation strength. Moreover, as the fixing fluid, any of those used and known customarily in this field can be used. Note that, in the image forming apparatus of the invention, the conditions such as materials, layer structures, and dimensions to be fulfilled by the constituent components including the intermediary transfer belt, the conveyance belt, and the individual rollers are not limited to those as suggested hereinabove. The conditions customarily adopted in the field of electrophotographic image forming technology may be used in their as-is state or with alterations. Moreover, instead of a roller element, an endless member such as a belt may be used. Further, the belt components such as the intermediary transfer belt and the conveyance belt may be constructed in the form of a roller instead of the form of an endless belt.

While the image forming apparatus according to each of the embodiments of the invention is exemplified as a tandem-system color image forming apparatus, the technique of the invention is not limited thereto but may be applied also to, for example, a so-called 4-rotation system color image forming apparatus in which an image of one given color is superimposedly produced each time an intermediary transfer belt makes one rotating. Moreover, the invention is not limited to a color image forming apparatus, and it may find application in a monochromatic image forming apparatus.

For example, the image forming apparatus of the invention may be built as a copier, a printer, a facsimile, or a multifunction machine that combines two or more kinds of functions mentioned just above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus to form images by means of electrophotography or electrostatic recording, comprising:

a toner image bearing section for bearing an unfixed toner image thereon; and a fixing fluid applying section for applying a fixing fluid which provides an effect of fixing toner onto a recording medium, to the unfixed toner image on the toner image bearing section, wherein the fixing fluid applying section includes:

a fixing fluid chamber having an opening formed facing the toner image bearing section;

an applying member formed into a roller shape and placed in an interior space of the fixing fluid chamber, for applying the fixing fluid to the unfixed toner image on the toner image bearing section in contact with the toner image bearing section, which is supported inside the fixing fluid chamber so as to be rotatable and moved to contact with and release from the toner image bearing section, and in which at least a certain part is projected outward through the opening of the fixing fluid chamber facing the toner image bearing section in spaced to a side wall of the fixing fluid chamber;

a seal member for closing a gap between the opening of the fixing fluid chamber and the applying member; and a contact and release operation section for supporting the fixing fluid chamber so that the applying member moves to contact with and release from the toner image bearing section, wherein at least the fixing fluid chamber, the applying member, and the seal member are integral with one another as a single unit which is freely attachable to and detachable from a main body of the image forming apparatus wherein the fixing fluid chamber places the applying member and also stores the fixing fluid in its interior space, the applying member is provided as a first applying member which is supported inside the fixing fluid chamber so as to be rotatable and moved to contact with and release from the toner image bearing section, has at least its certain part projected outward through the opening of the fixing fluid chamber facing the toner image bearing section in spaced to a side wall of the fixing fluid chamber, has at least its certain part located vertically above a level of the fixing fluid within the fixing fluid chamber, and has a slant region formed at its axial end portion, a diameter of its cross-section in a direction perpendicular to the length of the first applying member of which is tapered from a position near the end portion to the end portion, and the seal member is provided as a first seal member which is disposed so as to move to contact with and release from the applying member, and has an axial end portion which is brought into contact with the slant region of the applying member to close the gap between the opening of the fixing fluid chamber and the applying member.

2. The image forming apparatus of claim 1, wherein the fixing fluid applying section further comprises a cleaning member which is rotatably supported inside the fixing fluid chamber, makes contact with the first applying member, and is so arranged as to be kept clear of the fixing fluid within the fixing fluid chamber, and in which, at least a surface layer is made of a material which is larger in contact angle with water than the surface of the first applying member.

3. The image forming apparatus of claim 1, wherein the fixing fluid applying section further comprises:

a deformable fixing fluid container having an opening placed inside the fixing fluid chamber, which is filled with the fixing fluid; and an application wick for supplying the fixing fluid within the fixing fluid container to the first applying member, in which one end is inserted through the opening into the fixing fluid container to dip with the fixing fluid, and the other end is arranged in pressure-contact with the first applying member.

4. The image forming apparatus of claim 1, wherein the fixing fluid applying section further includes:

a liquid level detecting section for detecting an amount of the fixing fluid within the fixing fluid chamber; and a replacement timing indicating section for notifying of a timing of replacement of the fixing fluid applying section from a result detected by the liquid level detecting section.

5. The image forming apparatus of claim 4, wherein the liquid level detecting section includes:

a hollow position control member having a plurality of through holes formed on its side wall that permit inflow and outflow of the fixing fluid, in which one end protrudes from a liquid level of the fixing fluid within the fixing fluid chamber into the interior space of the fixing fluid chamber, and the other end is supported on the fixing fluid chamber while being dipped in the fixing fluid;

a first fixing-fluid level indicator member put in an interior space of the hollow position control member so as to float in the fixing fluid while moving up-and-down to change its vertical position depending upon increase and decrease of the fixing fluid;

a first position detecting section for detecting a position of the first fixing-fluid level indicator member in its vertical direction; and a fixing-fluid amount calculation section for determining the amount of the fixing fluid by calculation from a result detected by the first position detecting section.

6. An image forming apparatus to form images by means of electrophotography or electrostatic recording, comprising:

a toner image bearing section for bearing an unfixed toner image thereon; and a fixing fluid applying section for applying a fixing fluid which provides an effect of fixing toner onto a recording medium, to the unfixed toner image on the toner image bearing section, wherein the fixing fluid applying section includes:

a fixing fluid chamber having an opening formed facing the toner image bearing section;

an applying member formed into a roller shape and placed in an interior space of the fixing fluid chamber, for applying the fixing fluid to the unfixed toner image on the toner image bearing section in contact with the toner image bearing section, which is supported inside the fixing fluid chamber so as to be rotatable and moved to contact with and release from the toner image bearing section, and in which at least a certain part is projected outward through the opening of the fixing fluid chamber facing the toner image bearing section in spaced to a side wall of the fixing fluid chamber;

a seal member for closing a gap between the opening of the fixing fluid chamber and the applying member; and a contact and release operation section for supporting the fixing fluid chamber so that the applying member moves to contact with and release from the toner image bearing section, wherein at least the fixing fluid chamber, the applying member, and the seal member are integral with one another as a single unit which is freely attachable to and detachable from a main body of the image forming apparatus wherein the applying member is provided as a second applying member formed into a roller shape which is supported inside the fixing fluid chamber so as to be rotatable and moved to contact with and release from the toner image bearing section, with at least a certain part of which projected outward through the opening of the fixing fluid chamber facing the toner image bearing section in spaced to a side wall of the fixing fluid chamber, and in which is placed a fixing fluid storage chamber for storing therein the fixing fluid whereby to apply the fixing fluid within the fixing fluid storage chamber to the unfixed toner image on the toner image bearing section in contact with the toner image bearing section, and the seal member is provided as a second seal member for closing the gap between the opening of the fixing fluid chamber and the applying member, which is composed of a film-shaped member formed at a distance from or in intimate contact with the surface of a part of the applying member which is placed in the fixing fluid chamber and a supporting member for supporting the film-shaped member that is disposed in contact with both side of the opening in longitudinal direction of the fixing fluid chamber and with a part of the surface of the applying member in the vicinity of the both side of the opening.

7. The image forming apparatus of claim 6, wherein the second applying member includes:

a second fixing-fluid level indicator member which is supported inside the fixing fluid storage chamber so as to be rotatable about the axis of the second applying member depending upon increase and decrease of the fixing fluid;

a second position detecting section for detecting a position of the second fixing-fluid level indicator member; and fixing-fluid amount calculation section for determining the amount of the fixing fluid by calculation from a result detected by the second position detecting section.

8. An image forming apparatus to form images by means of electrophotography or electrostatic recording, comprising:

a toner image bearing section for bearing an unfixed toner image thereon; and a fixing fluid applying section for applying a fixing fluid which provides an effect of fixing toner onto a recording medium, to the unfixed toner image on the toner image bearing section, wherein the fixing fluid applying section includes:

a fixing fluid chamber having an opening formed facing the toner image bearing section;

an applying member formed into a roller shape and placed in an interior space of the fixing fluid chamber, for applying the fixing fluid to the unfixed toner image on the toner image bearing section in contact with the toner image bearing section, which is supported inside the fixing fluid chamber so as to be rotatable and moved to contact with and release from the toner image bearing section, and in which at least a certain part is projected outward through the opening of the fixing fluid chamber facing the toner image bearing section in spaced to a side wall of the fixing fluid chamber;

a seal member for closing a gap between the opening of the fixing fluid chamber and the applying member; and a contact and release operation section for supporting the fixing fluid chamber so that the applying member moves to contact with and release from the toner image bearing section, wherein at least the fixing fluid chamber, the applying member, and the seal member are integral with one another as a single unit which is freely attachable to and detachable from a main body of the image forming apparatus wherein the fixing fluid chambers is designed as a vessel member including a flat-shaped portion which is a bottom face when mounted in the image forming apparatus, and a lateral side constituted by a surface having a curvature.

* * * * *